US006611094B2

(12) United States Patent
Ogawa et al.

(10) Patent No.: US 6,611,094 B2
(45) Date of Patent: Aug. 26, 2003

(54) DOUBLE-FACED VACUUM FLUORESCENT DISPLAY DEVICE AND METHOD FOR DRIVING SAME

(75) Inventors: Yukio Ogawa, Mobara (JP); Kazuyoshi Ishikawa, Mobara (JP); Katsutoshi Kougo, Mobara (JP); Yoshikazu Iidaka, Mobara (JP); Hiroaki Kawasaki, Mobara (JP)

(73) Assignee: Futaba Denshi Kogyo Kabushiki Kaisha, Chiba (JP)

( * ) Notice: Subject to any disclaimer, the term of this patent is extended or adjusted under 35 U.S.C. 154(b) by 106 days.

(21) Appl. No.: 09/760,220

(22) Filed: Jan. 12, 2001

(65) Prior Publication Data

US 2001/0008361 A1 Jul. 19, 2001

(30) Foreign Application Priority Data

Jan. 12, 2000 (JP) ..... 2000-003369
May 18, 2000 (JP) ..... 2000-146291

(51) Int. Cl.[7] ..... H01J 1/62; H01J 63/04; H01J 1/46; H01J 21/10

(52) U.S. Cl. ..... 313/496; 313/293; 313/302

(58) Field of Search ..... 313/495, 496, 313/497, 293, 297, 298, 302, 303

(56) References Cited

U.S. PATENT DOCUMENTS 5,270,613 A * 12/1993 Kim ..... 313/293
5,463,276 A * 10/1995 Kawasaki et al. ..... 313/293
6,340,865 B2 * 1/2002 Kawasaki et al. ..... 313/495

FOREIGN PATENT DOCUMENTS

JP 2000-123765 * 4/2000

* cited by examiner

*Primary Examiner*—Susan S. Y. Lee
(74) *Attorney, Agent, or Firm*—Katten Muchin Zavis Rosenman

(57) ABSTRACT

A simple and slim double-faced vacuum fluorescent display device has no grid, thereby lowing the power consumption and fabrication cost thereof. Anode electrodes on one of the front plate and the back plate function as grids for anode electrodes on the other one of the front plate and the back plate. The light emitted from anode electrodes is not blocked by grids, thereby enhancing light emitting efficiency thereof.

19 Claims, 19 Drawing Sheets

DOUBLE-FACED VACUUM FLUORESCENT DISPLAY DEVICE AND METHOD FOR DRIVING SAME

FIELD OF THE INVENTION

The present invention relates to a double-faced vacuum fluorescent display device and a method for driving same, wherein the device has a front plate, a back plate and an anode electrode containing a fluorescent layer formed thereon.

BACKGROUND OF THE INVENTION

A conventional double-faced vacuum fluorescent display device is normally provided with a front plate, a back plate, front anode electrodes formed on the front plate and back anode electrodes formed on the back plate, each anode electrode containing a fluorescent layer coated thereon, wherein a grid is installed corresponding to each anode electrode and a filament is tightly hanged between two grids facing each other.

FIG. 15A shows a plan view of a conventional double-faced vacuum fluorescent display device 700. FIG. 15B illustrates a cross sectional view of the conventional double-faced fluorescent display device 700 taken along X–X'of FIG. 15A.

In FIGS. 15A and 15B, there are illustrated a front plate 71 of the fluorescent device 700, a front anode electrode 72 formed on the front plate 71 and a grid 74 corresponding thereto installed facing the front anode electrode 72, wherein a fluorescent layer 73 is coated on the front anode electrode 72. Further, there are illustrated a back plate 75 of the fluorescent device 700, a back anode electrode 76 formed on the back plate 75 and a grid 78 corresponding thereto installed facing the back anode electrode 76, wherein a fluorescent layer 77 is coated on the back anode electrode 76. A filament 79 is tightly hanged between the two grids 74 and 78 by two supporting members 80 and 80' disposed on the front plate 71. The grids 74 and 78 control the electron emission from the filament 79 toward the front anode electrode 72 and the back anode electrode 76 facing each other, respectively.

Since, however, in the conventional double-faced vacuum fluorescent display device 700, the grids 74 and 78 should be installed between the front anode electrode 72 and the back anode electrode 76, the fluorescent display device 700 is expensive, structurally complex and it is especially difficult to manufacture a light and slim type one. Further, the manufacturing process of the fluorescent display device 700 may be accompanied by certain other defects. For example, the alignment of the grids with the anode electrodes is difficult; and there occurs considerable power consumption due to the use of the grids.

SUMMARY OF THE INVENTION

It is, therefore, an object of the present invention to provide a simple and slim double-faced vacuum fluorescent display device whose power consumption and fabrication cost are low.

In accordance with a preferred embodiment of the present invention, there is provided a double-faced vacuum fluorescent display device including a front plate, a back plate and a filament installed between the front plate and the back plate facing each other, characterized in that the front plate has one or more front anode electrodes and the back plate has one or more back anode electrodes, each anode electrode containing a fluorescent layer coated thereon; the front anode electrodes function as control electrodes to control the electron emission from the filament toward the back anode electrodes; and the back anode electrodes function as control electrodes to control the electron emission from the filament toward the front anode electrodes.

In accordance with another preferred embodiment of the present invention, there is provided a double-faced vacuum fluorescent display device including a front plate, a back plate and a filament installed between the front plate and the back plate facing each other, characterized in that the front plate has one or more front anode electrodes and the back plate has one or more back anode electrodes, each anode electrode containing a fluorescent layer coated thereon; and when the front anode electrodes are selected to be turned on to emit light, the back anode electrodes function as control electrodes to control the electron emission from the filament toward the front anode electrodes; and when the back anode electrodes are selected to be turned on to emit light, the front anode electrodes function as control electrodes to control the electron emission from the filament toward the back anode electrodes.

BRIEF DESCRIPTION OF THE DRAWINGS

The above and other objects and features of the present invention will become apparent from the following description of the preferred embodiments given in conjunction with the accompanying drawings, wherein.

DETAILED DESCRIPTION OF THE PREFERRED EMBODIMENTS

Figure 1:
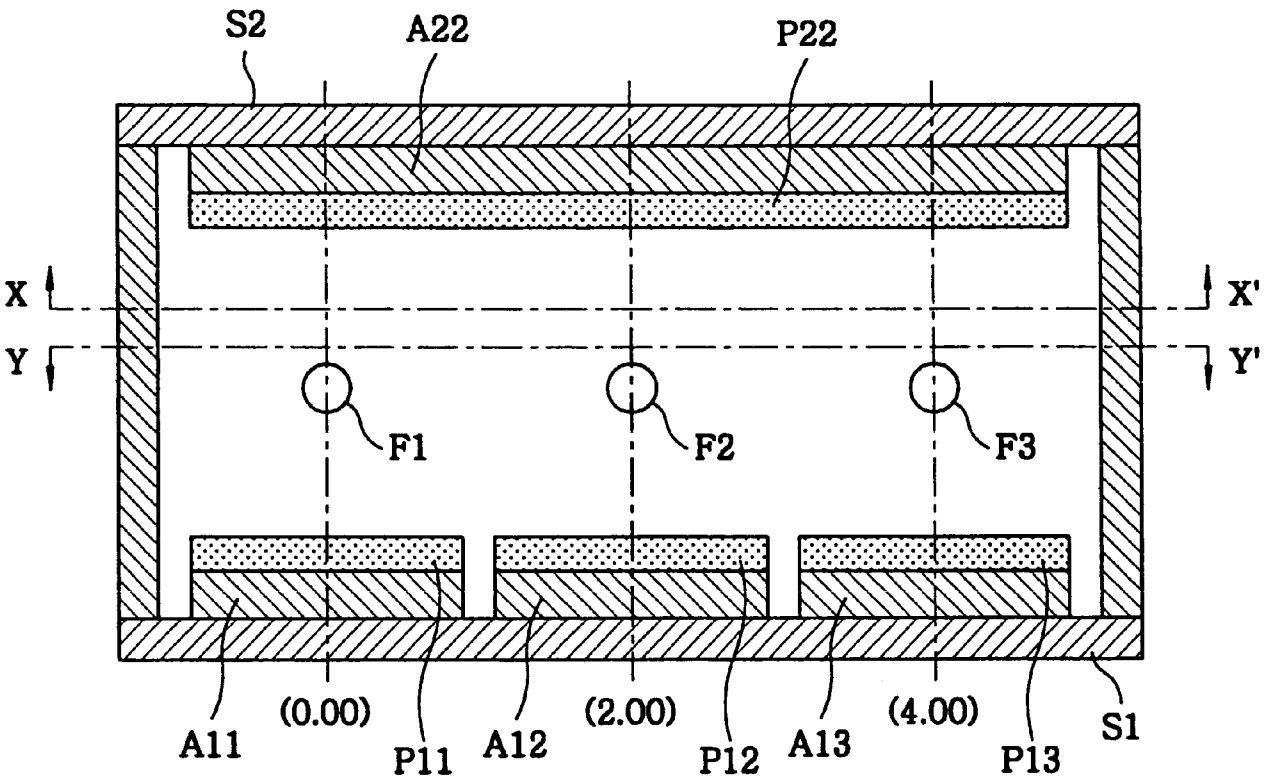
FIG. 1 shows a cross sectional view of a double-faced vacuum fluorescent display device in accordance with a preferred embodiment of the present invention.
Figure 2A:
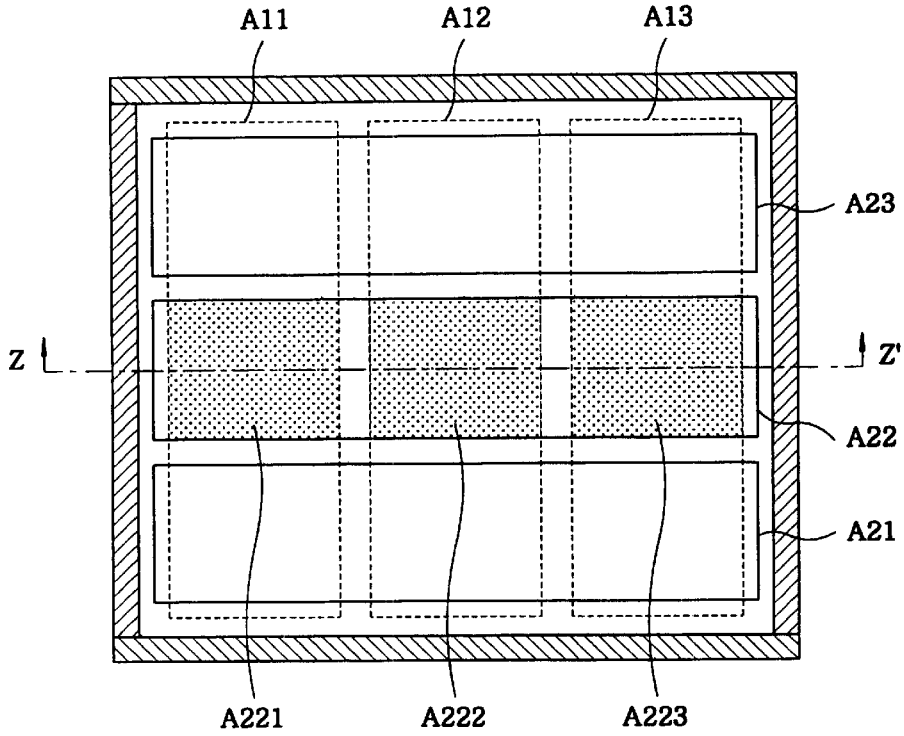
FIGS. 2A and 2B depict cross sectional views taken along X–X' and Y–Y' of FIG. 1, respectively.
Figure 2B:
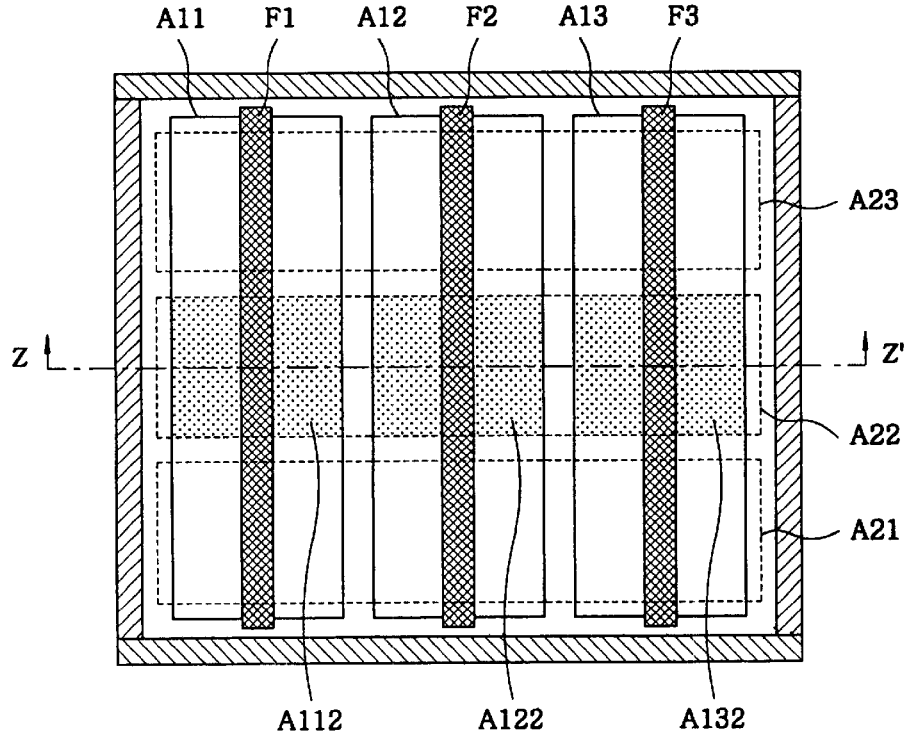

FIG. 1 shows a cross sectional view of a double-faced vacuum fluorescent display device 100 in accordance with a preferred embodiment of the present invention. FIGS. 2A and 2B illustrate plan views of the fluorescent display device 100. FIG. 1 is a cross sectional view taken along Z–Z' of FIGS. 2A and 2B. FIG. 2A is a cross sectional view taken along X–X' of FIG. 1; and FIG. 2B is a cross sectional view taken along Y–Y' of FIG. 1. In FIGS. 2A and 2B, there are shown electrodes and filaments while a fluorescent layer coated on the electrodes are not shown.

An electric field analysis of the double-faced vacuum fluorescent display device 100 as represented in FIGS. 1, 2A and 2B of the present invention is carried out to thereby determine the operational principle thereof. Referring to FIGS. 1, 2A and 2B, the double-faced vacuum fluorescent display device 100 includes a front plate S1, a back plate S2, front anode electrodes A11 to A13, back anode electrodes A21 to A23, fluorescent layers P11 to P13 coated on the front anode electrodes A11 to A13, respectively, a fluorescent layer P22 coated on the back anode electrode A22, and filaments F1 to F3 installed between the front plate S1 and the back plate S2 facing each other. Reference numerals A112 to A132 and A221 to A223 represent respective crossing portions of the front anode electrodes A11 to A13 and the back anode electrode A22. The filaments F1 to F3 are disposed within an area where the electron emission from the filaments F1 to F3 can be controlled by the front anode electrodes A11 to A13 and the back electrodes A21 to A23.

The width of the back anode electrode A22 is about 6 mm; the spacing between the filaments F1 to F3 and the front anode electrodes A11 to A13 or the back anode electrode A22 is about 0.5 mm; and the spacing between two adjacent filaments is about 2 mm, wherein the width of the back anode electrode A22 corresponds to the distance from the left end of the front anode electrode A11 to the right end of the front anode electrode A13. Considering the contact of the filaments F1 to F3 with the front anode electrodes A11 to A13 or the back anode electrode A22 and the range of a control voltage for the front anode electrodes A11 to A13 or the back anode electrode A22, it is preferable that the spacing between the filaments F1 to F3 and the front anode electrodes A11 to A13 or the back anode electrode A22 ranges from 0.1 mm to a few mm.

In this case, it is possible to increase the spacing between the filaments F1 to F3 and the front anode electrodes A11 to A13 or the back anode electrode A22 by raising a cut-off voltage applied to a control electrode higher. In real situation, in view of cost and a breakdown voltage of a driving IC, it is preferable that the spacing between the filaments F1 to F3 and the front anode electrodes A11 to A13 or the back anode electrode A22 ranges from about 0.5 mm to about 1.5 mm.

In FIG. 1, the point values 0.00, 2.00 and 4.00 correspond to locations of the filaments F1, F2 and F3, respectively, in the horizontal axis. From now on, voltages applied to the front anode electrodes A11 to A13 and the back anode electrodes A21 to A23 and filaments F1 to F3 will be described.

First, in the present invention, a filament voltage is represented as $V_f$ and there are defined first to fourth voltages V1 to V4, wherein V2>$V_f$, V3<$V_f$, V3<V4<$V_f$, V2>V1 if V1>$V_f$, V4<V1 if V1<$V_f$. The V1 ranges −HV (e.g., −3V) to +MV (e.g., +3V), H and M being positive integers, respectively. In accordance with a first preferred embodiment of the present invention, $V_f$=0V, V1=0V, V2=12V, V3=−25V and V4=−12V.

The operation of the double-faced vacuum fluorescent display device 100 will be described hereinafter. Each of the front anode electrodes A11 to A13 formed on the front plate S1 and the back anode electrode A21 to A23 formed on the back plate S2 acts as both a light emitting electrode and an electron emission control electrode.

When the front anode electrodes A11 to A13 are selected to be turned on to emit light, the back anode electrodes A21 to A23 function as control electrodes to control the electron emission from the filaments F1 to F3 toward the front anode electrodes A11 to A13; and when the back anode electrodes A21 to A23 are selected to be turned on to emit light, the front anode electrodes A11 to A13 function as control electrodes to control the electron emission from the filaments F1 to F3 toward the back anode electrodes A21 to A23. This will be described in more details referring to FIGS. 3 and 4 and the following table 1.

FIGS. 3A to 3D and FIGS. 4A to 4D respectively provide results obtained by conducting the electric field analysis on the double-faced vacuum fluorescent display device 100. In FIGS. 3A to 3D and FIGS. 4A to 4D, each vertical axis represents current densities (mA/cm$^2$) for a front anode electrode current $I_p$ and a back anode electrode current $I_{back}$; and each horizontal axis represents a distance in width direction (mm) of the back anode electrode A22.

TABLE 1

Figure 3A:
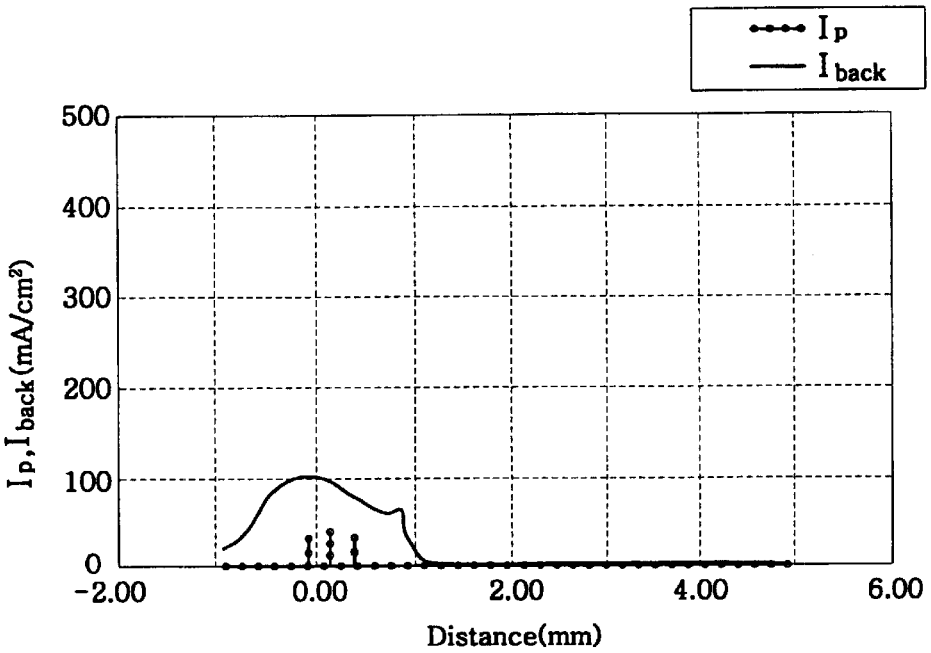
FIGS. 3A to 3D illustrate current density curves of anode electrode currents obtained by conducting an electric field analysis on the double-faced vacuum fluorescent display device shown in FIG. 1.
Figure 3B:
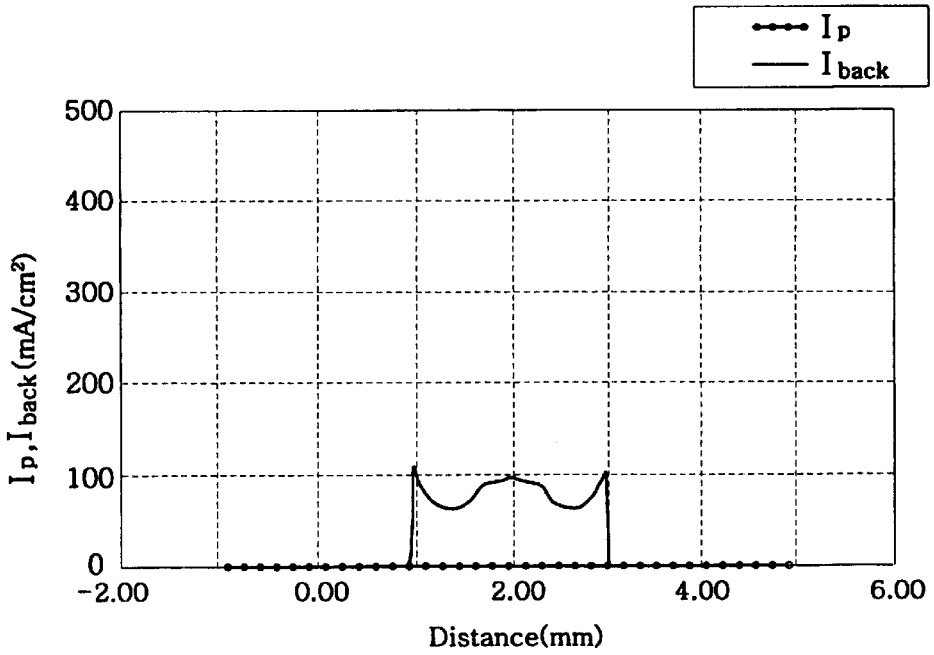
Figure 3C:
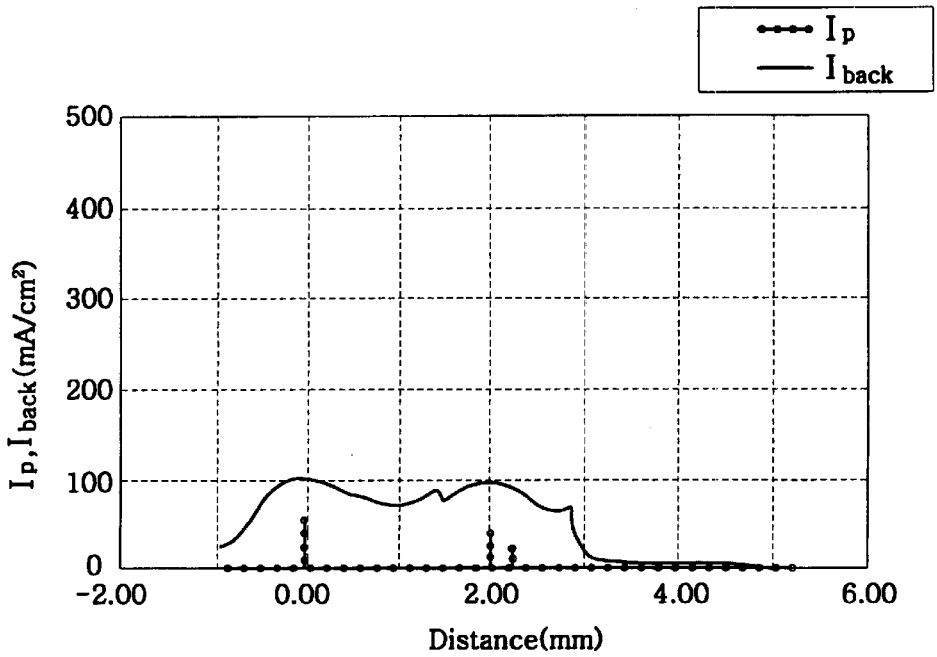
Figure 3D:
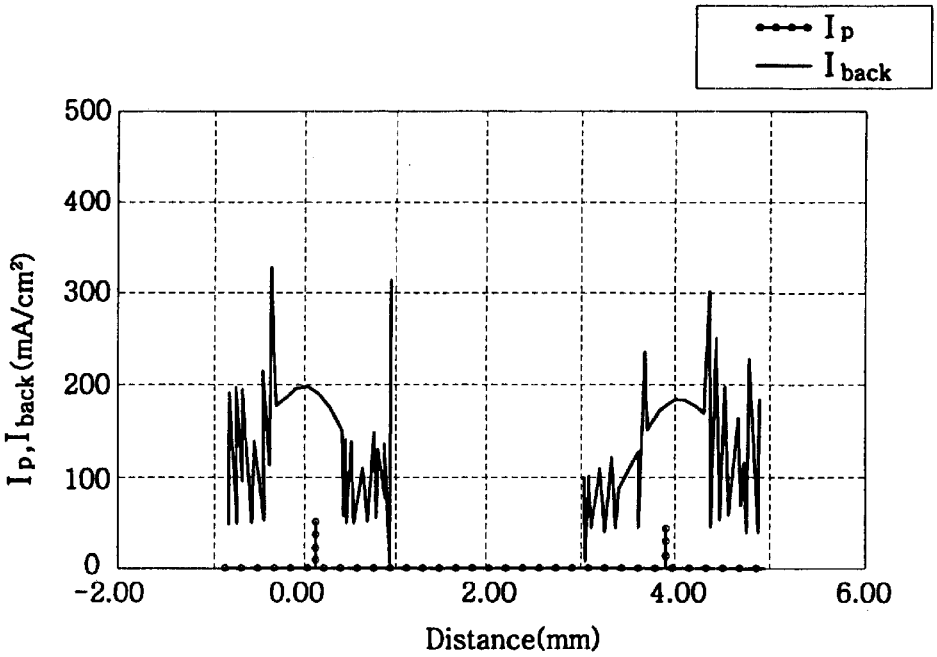
Figure 4A:
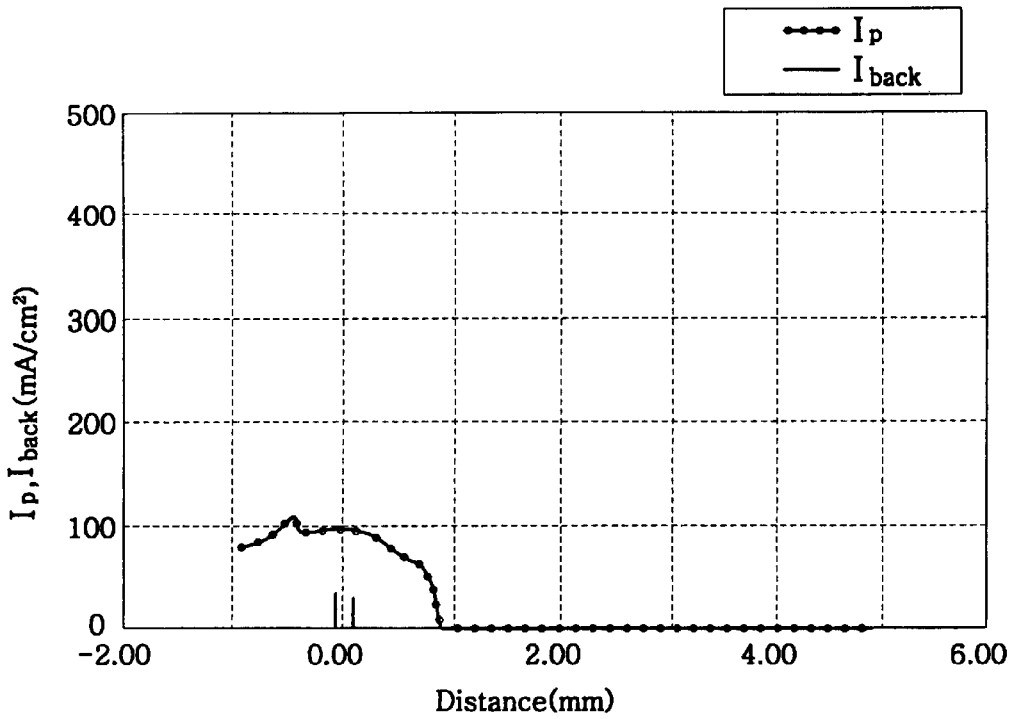
FIGS. 4A to 4D provide current density curves of anode electrode currents obtained by conducting an electric field analysis on the double-faced vacuum fluorescent display device shown in FIG. 1.
Figure 4B:
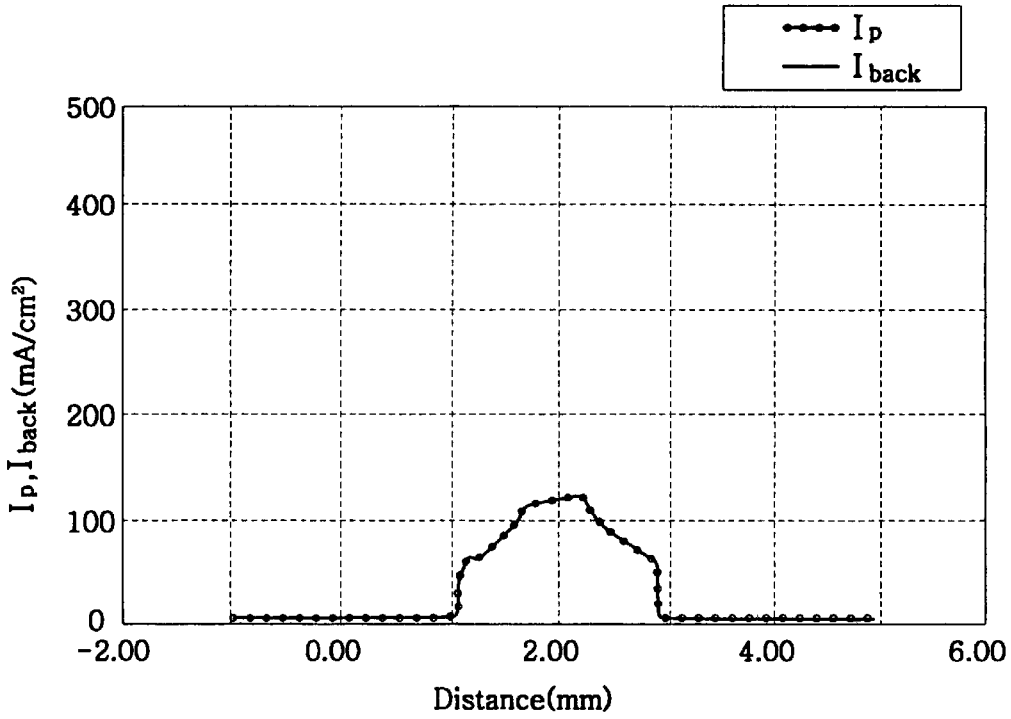
Figure 4C:
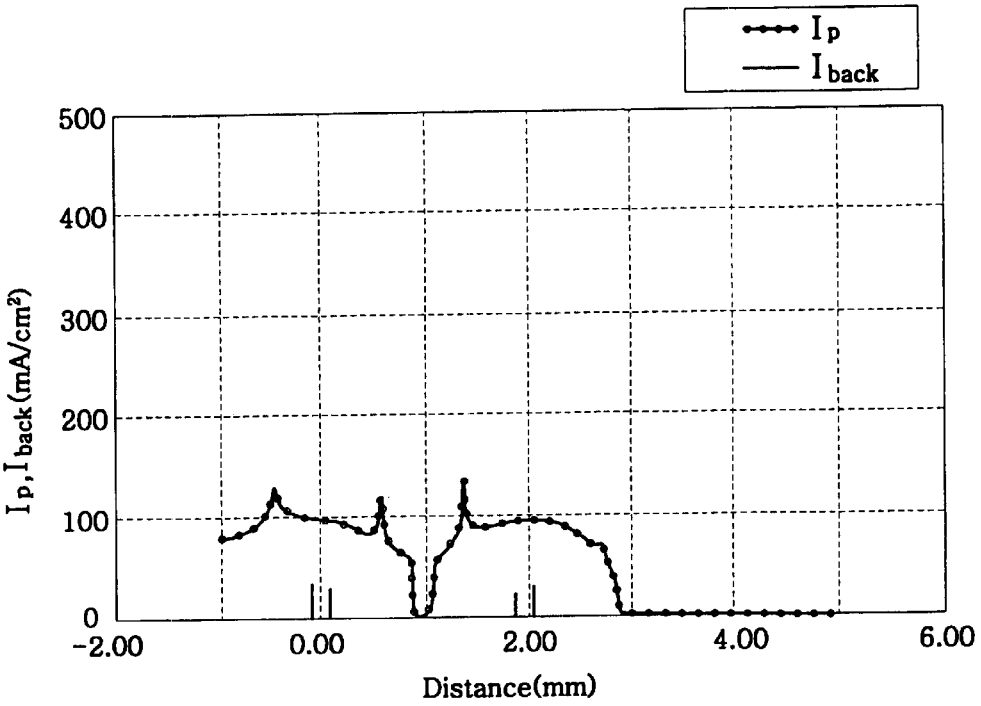
Figure 4D:
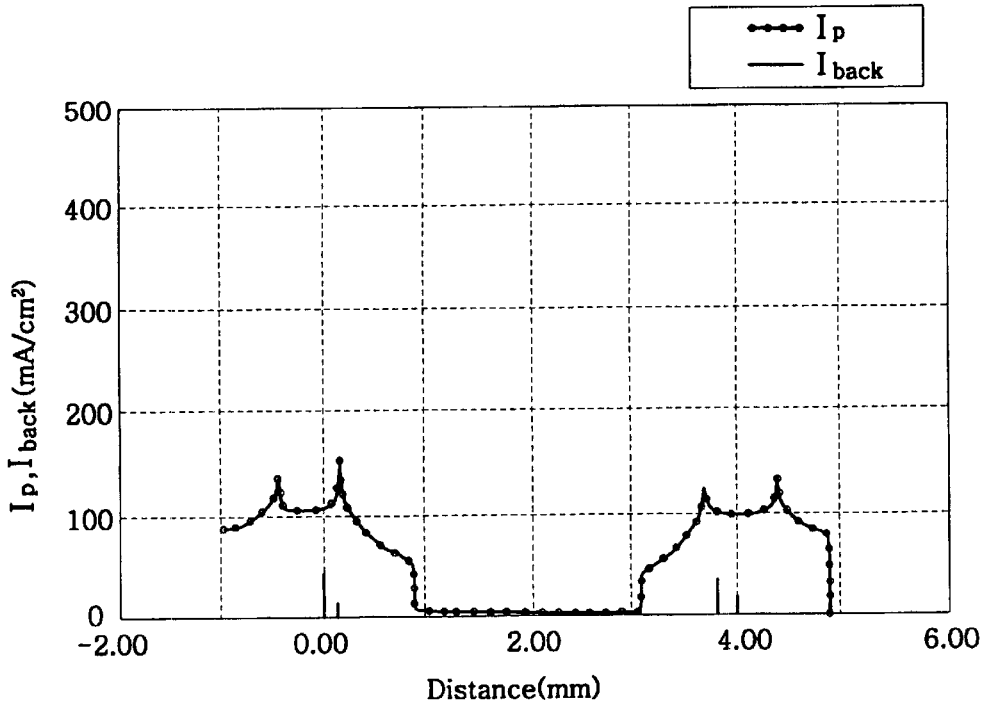

| | | | Voltage applying parts, Applied voltage | | | | | |
|---|---|---|---|---|---|---|---|---|
| | | Emitting | Back anode electrode | | | Front anode Electrode | | |
| Cases | Plate | part | A21 | A22 | A23 | A11 | A12 | A13 |
| FIG. 3A | Back | A221 | 0 | 12 | 0 | 0 | −25 | −25 |
| FIG. 4A | Front | A112 | −12 | 0 | −12 | 12 | 0 | 0 |
| FIG. 3B | Back | A222 | 0 | 12 | 0 | −25 | 0 | −25 |
| FIG. 4B | Front | A122 | −12 | 0 | −12 | 0 | 12 | 0 |
| FIG. 3C | Back | A221, A222 | 0 | 12 | 0 | 0 | 0 | −25 |
| FIG. 4C | Front | A112, A122 | −12 | 0 | −12 | 12 | 12 | 0 |
| FIG. 3D | Back | A221, A223 | 0 | 12 | 0 | 0 | −25 | 0 |
| FIG. 4D | Front | A112, A132 | −12 | 0 | −12 | 12 | 0 | 12 |

The point values 0.00, 2.00 and 4.00 correspond to locations of the filaments F1, F2 and F3, respectively in the horizontal axes of FIG. 1. In the table 1, there are listed combinations of light emitting sides, i.e., the front plate S1 or the back plate S2, light emitting parts, voltages applied to the front anode electrodes A11 to A13 and the back anode electrodes A21 to A23 and cases represented by FIGS. 3A to 3D and FIGS. 4A to 4D, wherein the light emitting parts correspond to crossing portions of the front anode electrodes A11 to A13 and the back anode electrode A22 in FIGS. 2A and 2B.

FIG. 3A sets forth a current density curve obtained by conducting the electric field analysis on the double-faced vacuum fluorescent display device 100 when a crossing part A221 of the back anode electrode A22 is selected to be turned on to emit light, wherein 12V is applied to the back anode electrode A22, 0V to the back anode electrodes A21, A23 and the front anode electrode A11 and −25V to the front anode electrodes A12 and A13. In this case, it can be understood that a back anode electrode current $I_{back}$ thereof is uniform over the area covering the right and left sides of the point 0.00 of the back anode electrode A22, i.e., the entire region of the crossing part A221. There entails a small amount of current $I_p$ of the front anode electrode A11 around the point 0.00.

As a result, referring to FIG. 3A, almost all the electrons generated from the filament F1 are uniformly emitted toward the crossing part A221 of the back anode electrode A22 by the help of the front anode electrode A11. The front anode electrode A11 functions as a control electrode controlling the electron emission from the filament F1 toward the back anode electrode A22.

FIG. 4A presents a current density curve obtained by conducting the electric field analysis on the double-faced vacuum fluorescent display device 100 when a crossing part A112 of the front anode electrode A11 is selected to be turned on to emit light, wherein 0V is applied to the back anode electrode A22 and the front anode electrodes A12, A13, −12V to the back anode electrodes A21 and A23 and 12V to the front anode electrode A11. In this case, it can be understood that a front anode electrode current $I_p$ thereof is uniform over the area covering the right and left sides of the point 0.00 of the back anode electrode A22, i.e., the entire region of the crossing part A112. There entails a small amount of a current $I_{back}$ of the front anode electrode A22 around the point 0.00.

As a result, referring to FIG. 4A, most of the electrons generated from the filament F1 are uniformly emitted toward the crossing part A112 of the back anode electrode A11 by the help of the back anode electrode A22. The back anode electrode A22 functions as a control electrode controlling the electron emission from the filament F1 toward the front anode electrode A11.

FIG. 3C depicts a current density curve obtained by conducting the electric field analysis on the double-faced vacuum fluorescent display device 100 when crossing parts A221 and A222 of the back anode electrodes A22 are selected to be turned on to emit light, wherein 12V is applied to the back anode electrode A22, 0V to the back anode electrodes A21, A23 and the front anode electrodes A11, A12 and −25V to the front anode electrode A13. In this case, it can be understood that a back anode electrode current $I_{back}$ thereof is uniform over the area covering the entire region of the crossing parts A221 and A222 of the back anode electrode A22. There entails a small amount of current $I_p$ of the front anode electrodes A11 and A12 around the points 0.00 and 2.00.

As a result, referring to FIG. 3C, most of the electrons generated from the filaments F1 and F2 are uniformly emitted toward the crossing parts A221 and A222 of the back anode electrode A22 by the help of the front anode electrodes A11 and A12. The front anode electrodes A11 and A12 function as control electrodes controlling the electron emission from the filaments F1 and F2 toward the back anode electrodes A22.

FIG. 4C gives a current density curve obtained by conducting the electric field analysis on the double-faced vacuum fluorescent display device 100 when crossing parts A112 and A122 of the front anode electrodes A11 and A12 are selected to be turned on to emit light, wherein 0V is applied to the back anode electrode A22 and the front anode electrode A13, −12V to the back anode electrodes A21 and A23, 12V to the front anode electrodes A11 and A12. In this case, it can be understood that a front anode electrode current $I_p$ thereof is uniform over the area covering the entire region of the crossing parts A112 and A122 of the front anode electrodes A11 and A22. There entails a small amount of current $I_{back}$ of the front anode electrode A22 around the points 0.00 and 2.00.

As a result, referring to FIG. 4C, most of the electrons generated from the filaments F1 and F2 are uniformly emitted toward the crossing parts A112 and A122 of the front anode electrodes A11 and A12 by the help of the back anode electrode A22. The back anode electrode A22 functions as a control electrode controlling the electron emission from the filaments F1 and F2 toward the front anode electrodes A11 and A12.

In the cases represented by FIGS. 3B and 3D and FIGS. 4B and 4D, similar to the cases described above, when a front anode electrode is selected to be turned on to emit light, a back anode electrode functions as a control electrode to control the electron emission from the filament toward the front anode electrode; and when a back anode electrode is selected to be turned on to emit light, the front anode electrode functions as a control electrode to control the electron emission from the filament toward the back anode electrode. Accordingly, one or more anode electrodes on the front plate or the back plate can be turned on to emit light without employing a grid.

As described above, without installing a grid therein, an anode electrode on one of the front plate side and the back plate side can be arranged to be installed in a range such that electron emission from a filament toward a corresponding anode electrode on the other plate side can be controlled and at the same time, the corresponding anode electrode on the other plate is installed in a range such that electron emission from a filament toward the anode electrode facing thereto can be controlled and accordingly, the electron emission thereof can be effectively controlled. This can be also achieved in the cases that each of the anode electrodes A21 and A23 acts as a light emitting electrode or a control electrode.

Figure 5A:
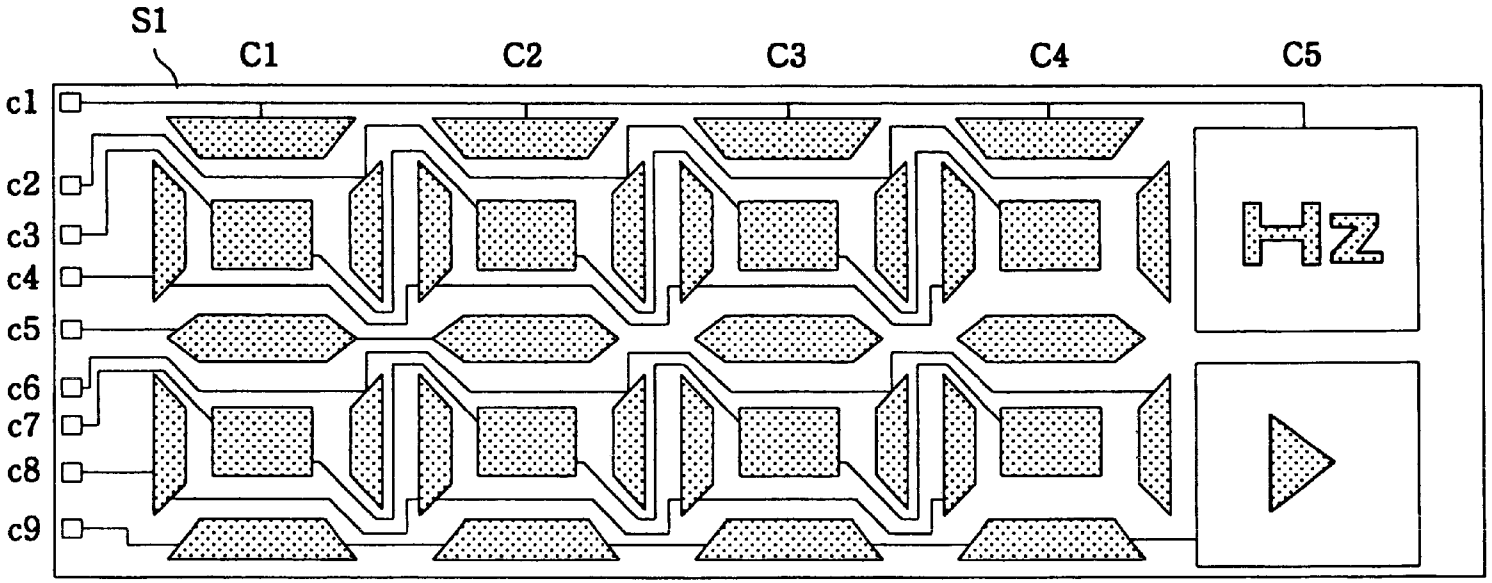
FIGS. 5A and 5B describe patterns and wirings of anode electrodes in accordance with a first preferred embodiment of the present invention.
Figure 5B:
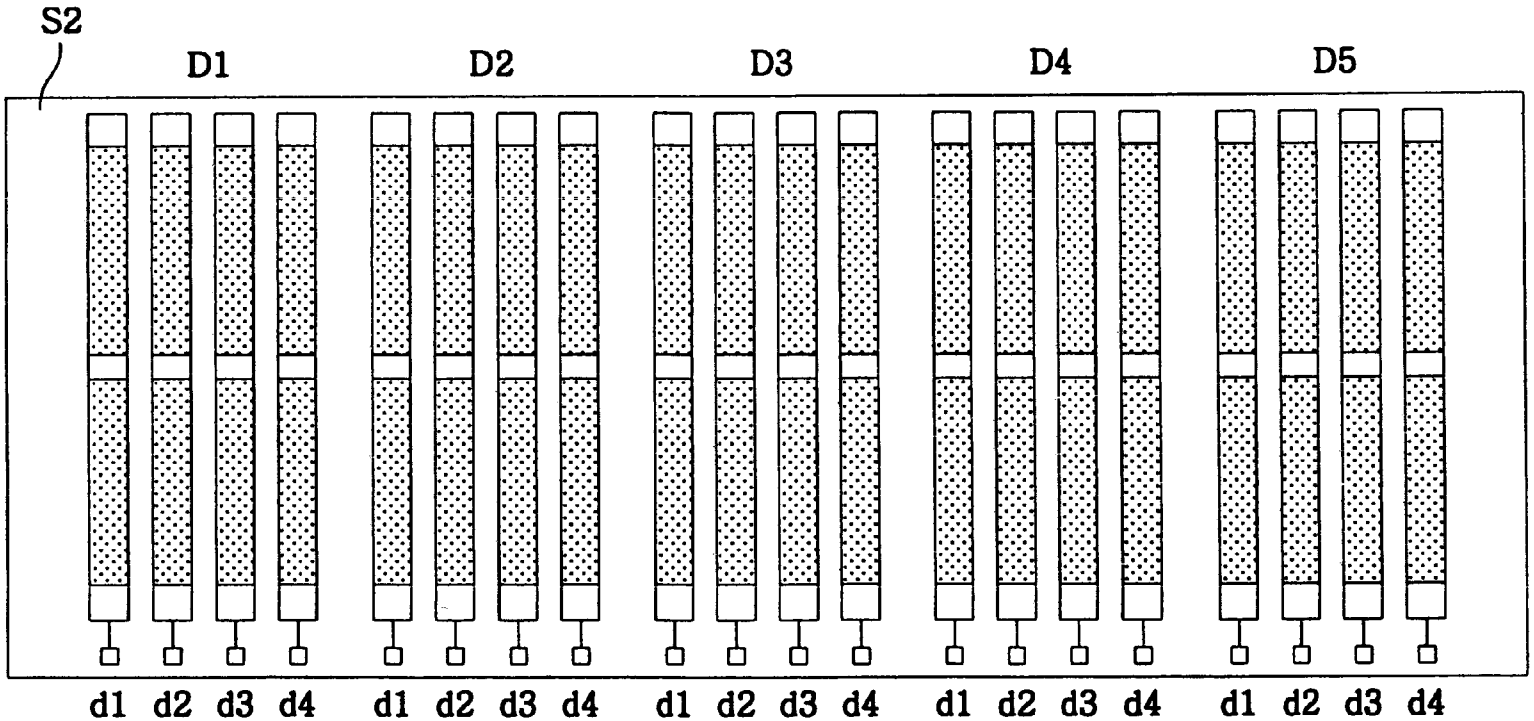
Figure 6A:
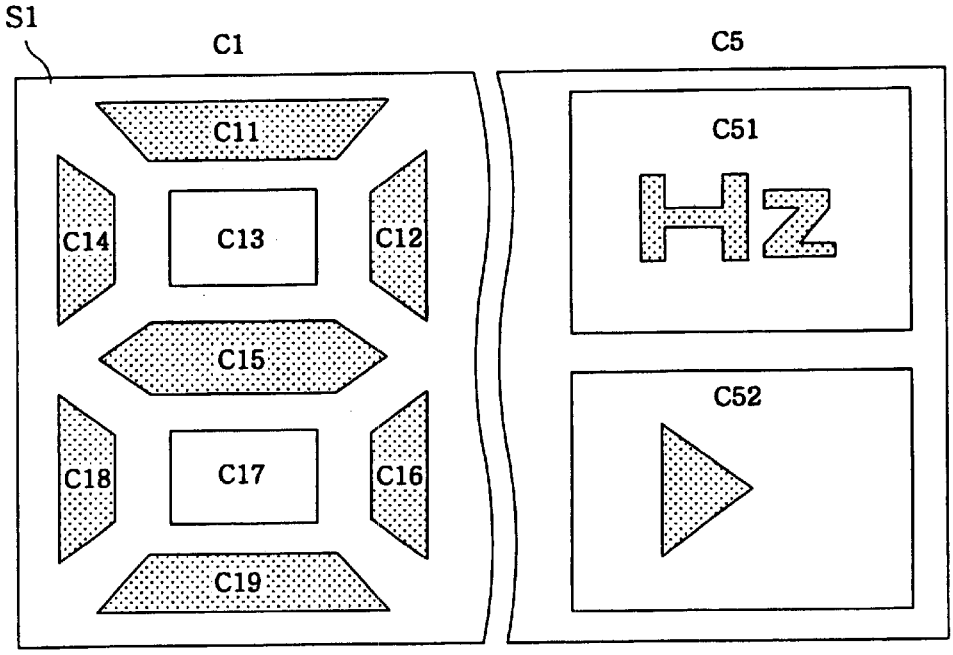
FIGS. 6A and 6B are enlarged fragmentary views of FIGS. 5A and 5B, respectively.
Figure 6B:
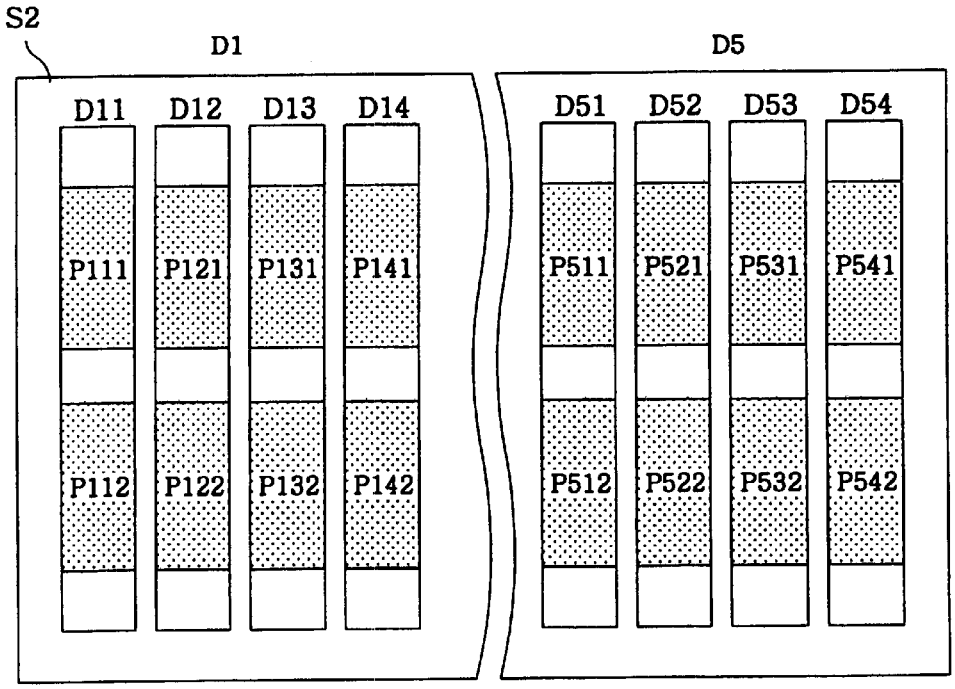

FIGS. 5A and 5B describe patterns and wirings of anode electrodes in accordance with a first preferred embodiment of the present invention. FIGS. 6A and 6B are enlarged fragmentary views of FIGS. 5A and 5B, respectively. Preferred embodiments illustrated in FIGS. 5A to 5B and 6A to 6B can be achieved in a double-faced vacuum fluorescent display device including a digital display front plate S1 and an analog display back plate S2, thereby enabling digital display and analog display simultaneously.

Referring to FIG. 5A, on the front plate S1, there are formed first front anode electrode sets C1 to C4, each first front anode electrode set having nine anode electrode segments and a second front anode electrode set C5 having two anode electrode segments. The nine anode electrode segments in each of the first front anode electrode sets C1 to C4 have seven segments C11, C12, C14, C15, C16, C18 and C19 constituting the front anode electrode set C1 forming a shape of "⊟" as shown in FIG. 6A and two segments C13 and C17, wherein each of the segments C11, C12, C14, C15, C16, C18 and C19 contains a fluorescent layer coated thereon while each of the segments C13 and C17 does not contain a fluorescent layer. The segments C13 and C17 do not function as light emitting elements and instead, they act as supplementary electrodes to help the function of control electrodes to be described later. Each of the first front anode electrode sets C2 to C4 has the same structure as the first anode electrode set C1.

The second front anode electrode set C5 has two segments C51 and C52, wherein only the parts of shape "Hz" and "▷" contain flat fluorescent layers as shown in FIG. 6A. One segment in each of the anode electrode sets C1 to C5 is serially connected to corresponding segments in the other anode electrode sets as shown in FIG. 5A. Namely, segments are so-called dynamically connected to each other and connected to terminals c1 to c9 as shown in FIG. 5A.

Referring to FIG. 5B, on the back plate S2, there are formed five back anode electrode sets D1 to D5, each back anode electrode set having four anode electrode segments of bar shapes. The four anode electrode segments in each of the back anode electrode sets D1 to D5 are constituted as illustrated in FIG. 6B. Referring to FIG. 6B, a back anode electrode set D1 has four electrode segments D11 to D14; and a back anode electrode set D5 has four electrode segments D51 to D54. On upper portions P111 to P141 and P511 to P541 and lower portions P112 to P142 and P512 to P542 of each of the electrode segments D1 to D14 and D51 to D54, there are formed fluorescent reflective parts having fluorescent layers coated thereon, respectively.

Each of the back anode electrode sets D2 to D4 has a same structure as the back anode electrode set D1. Four segments in each of the back anode electrode sets D1 to D5 are connected to terminals d1 to d4, respectively as shown in FIG. 5B. The displays of the back anode electrode sets D1 to D5 can be controlled in consideration of the intensity of a corresponding display signal, thereby enabling light emitting segments to shift toward left or right.

The front anode electrode sets C1 to C5 on the front plate S1 are arranged to face the back anode electrode sets D1 to D5 on the back S2, respectively. Filaments are tightly installed in the middle position between the front plate S1 and the back plate S2 in longitudinal direction, i.e., in the crossing direction to the anode electrodes D1 to D5. The number of filaments may be selected arbitrarily.

It is preferable that five filaments are installed in such a way that one filament faces the electrode segment C11 in each of the first front anode electrode sets C1 to C4; one filament faces the electrode segment C15; one filament faces the electrode segment C19; one filament faces the part having the shape "Hz" of the segment C51 in the second front anode electrode set C5 and electrode segments C14 and C12; and one filament faces the part having the shape of "▷" of the segment C52 in the second front anode electrode set C5 and electrode segments C16 and C18. By installing a filament facing to a light emitting segment, controlling of electron emission from the filament can be more effective and exact.

The operation of the double-faced vacuum fluorescent display device in accordance with a second embodiment of the present invention is basically same as that of the first embodiment described above. Voltages applied to the filaments and anode electrodes are same as those of the cases represented by FIGS. 1 and 2A to 2B. In the second preferred embodiment of the present invention, $V_f$=0V, V1=0V, V2=12V, V3=−25V, V4=−12V.

When the front anode electrode sets C1 to C5 on the front plate S1 are selected to be turned on to emit light, the back anode electrode sets D1 to D5 function as control electrodes to control the electron emission from the corresponding filaments toward the front anode electrode sets C1 to C5; and when the back anode electrode sets D1 to D5 are selected to be turned on to emit light, the front anode electrode sets C1 to C5 function as control electrodes to control the electron emission from the corresponding filaments toward the back anode electrode sets D1 to D5.

By employing a method applying varying signals to the terminals d1 to d4 and c1 to c9, one of the segments in the front anode electrode sets C1 to C5 can be selected as a control electrode for one of the segments in the back anode electrode sets D1 to D5; and one of the segments in the back anode electrode sets D1 to D5 can be selected as a control electrode for one of the segments in the front anode electrode sets C1 to C5.

Figure 7:
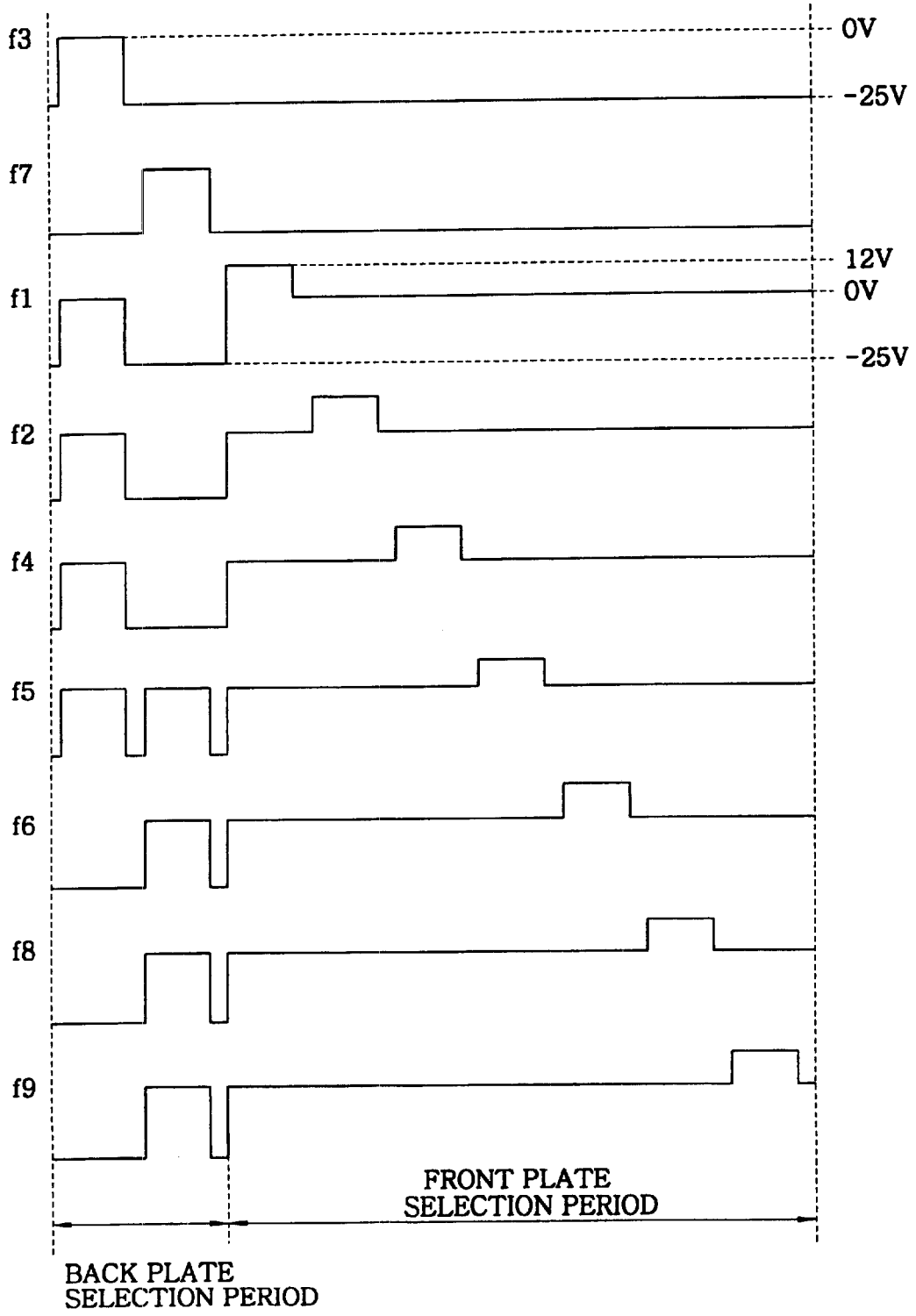
FIG. 7 sets forth a timing chart of signals applied to the terminals c1 to c9 of the front plate S1 and the terminals c1 to d4 of the back plate S2 in accordance with a first embodiment of the invention, respectively.
Figure 8:
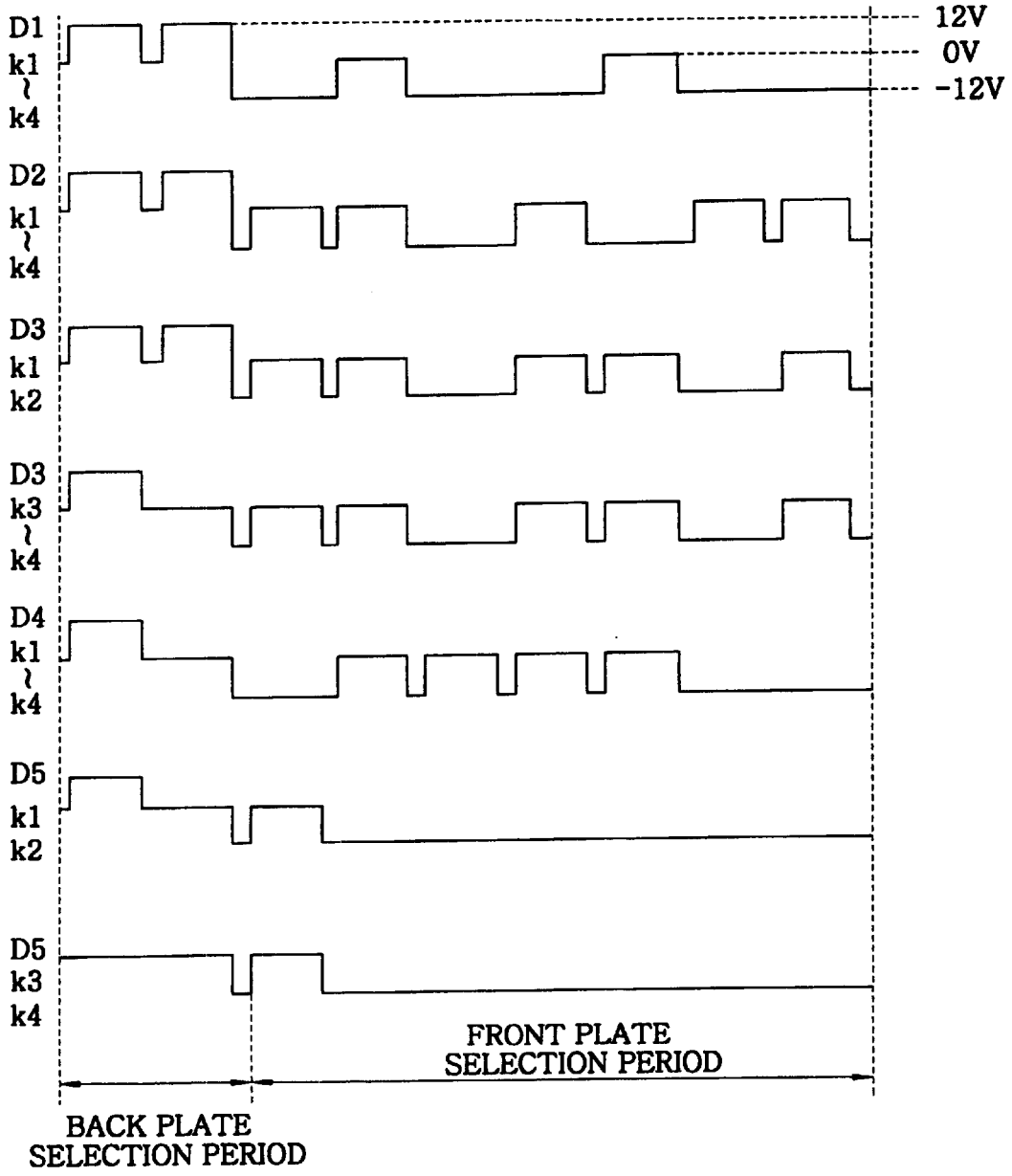
FIG. 8 offers forth a timing chart of signals applied to the terminals c1 to c9 of the front plate S1 and the terminals d1 to d4 of the back plate S2, respectively.
Figure 9A:
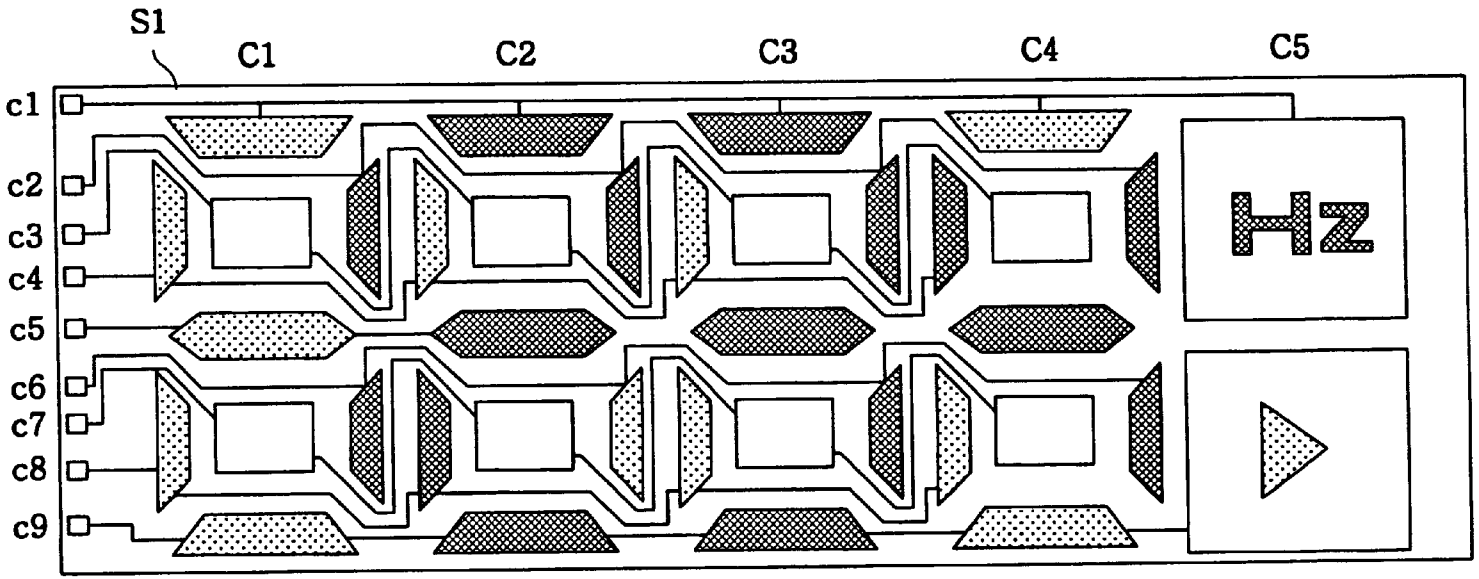
FIGS. 9A and 9B present exemplary display configurations corresponding to the timing charts of FIGS. 7 and 8, respectively.
Figure 9B:
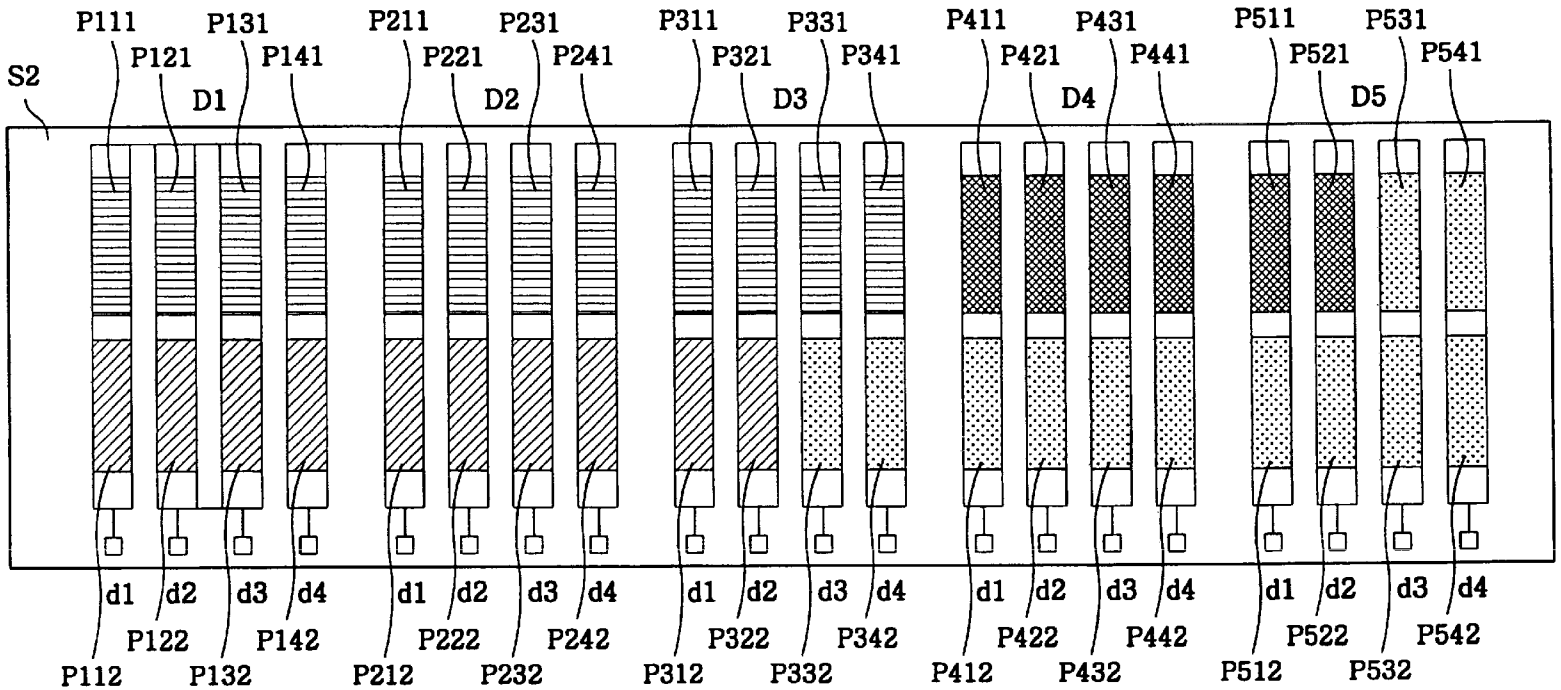

FIGS. 7 and 8 offer timing charts of signals f1 to f9 applied to the terminals c1 to c9 of the front plate S1 and those k1 to k4 applied to the terminals d1 to d4 of the back plate S2, respectively. FIGS. 9A and 9B present exemplary display configurations corresponding to the timing charts of FIGS. 7 and 8, respectively. Elements indicated by using same reference numerals in FIGS. 6 and 9 represent same elements. It can be understood that as an exemplary display configuration on the front plate, "1234 Hz" is represented by the front anode electrode sets C1 to C5 in FIG. 9A.

FIG. 9B is an exemplary display configuration on the back plate S2. Upper fluorescent parts P111 to P341 of the segments D11 to D13 in the back anode electrode sets D1 to D3 emit and display green lights; lower fluorescent parts P112 to P322 of the segments D11 to D32 therein emit and display blue lights. Upper fluorescent parts P411 to P521 of the segments D41 to D52 in the back anode electrode sets D4 and D5 emit and display red lights. From now on, back plate selection periods will be described.

First, when 0V is applied to terminals c3, c1, c2, c4 and c5 of the front plate S1 and at the same time, 12V is applied to terminals d1 to d4 of the back anode electrode sets D1 to D4 and terminals d1 and d2 of the back anode electrode set D5, the upper fluorescent parts P111 to P341 of the segments D11 to D34 emit green lights and the upper fluorescent parts P411 to P521 of the segments D41 and D52 emit red lights. In this case, segments connected to terminals c3, c1, c2, c4 and c5 in each of the front anode electrode sets C1 to C5 function as control electrodes to control the electron emission from the filaments toward the upper parts of the segments in the back anode electrode sets D1 to D5.

Then, when 0V is applied to terminals c7, c5, c6, c8 and c9 of the front plate S1 and at the same time, 12V is applied to terminals d1 to d4 of the back anode electrode sets D1 and D2, terminals d1 and d2 of the back anode electrode set D3 and the lower fluorescent parts P112 to P322 of the segments D11 to D32 emit blue lights. In this case, segments connected to terminals c7, c5, c6, c8 and c9 in each of the front anode electrode sets C1 to C5 function as control electrodes to control the electron emission from the filaments toward the lower parts of the segments in the back anode electrode sets D1 to D5.

In the back plate selection period, 0V is applied to the terminals d1 to d4 during the period when 12V is not applied thereto; and −25V is applied to the terminals c1 to c9 during the period when 0V is not applied thereto. In the back plate selection period as described above, 12V is applied to selected segments, i.e., segments selected to be turned on to emit light, in the back anode electrode sets D1 to D5 on the back plate S2 and 0V is applied to unselected segments, i.e., segments not selected to be turned on to emit light. 0V is applied to selected segments in the front anode electrode sets C1 to C5 on the front plate S1 and −25V is applied to unselected segments. From now on, front plate selection periods will be described.

First, when, in order to display "1" in selected segments in the front anode electrode set C1 on the front plate S1, 12V is applied to terminals c2 and c6 and 0V is applied to terminals d1 to d4 of the back anode electrode set D1, segments C12 and C16 of the front anode electrode set C1 emit lights to thereby display "1". In this case, the segments D11 to D14 of the back anode electrode set D1 function as control electrodes to control the electron emission from the filaments toward the segments C12 and C16 of the front anode electrode set C1.

Next, when, in order to display "2" in the front anode electrode set C2, 12V is applied to terminals c1, c2, c5, c8 and c9 and 0V is applied to terminals d1 to d4 of the back anode electrode set D2, segments C21, C22, C25, C28 and C29 of the front anode electrode set C2 emit lights to thereby display "2". In this case, the segments D21 to D24 of the back anode electrode set D2 function as control electrodes to control the electron emission from the filaments toward the segments C21, C22, C25, C28 and C29 of the front anode electrode set C2.

Similarly, "3", "4", "Hz" are displayed on the front anode electrode sets C3 to C5. In the front plate selection period, 0V is applied to the terminals c1 to c9 during the period when 12V is not applied thereto; and −12V is applied to the terminals d1 to d4 during the period when 0V is not applied thereto.

In the front plate selection period as described above, 12V is applied to selected segments in the front anode electrode sets C1 to C5 on the front plate S1 and 0V is applied to unselected segments. 0V is applied to selected segments in the back anode electrode sets D1 to D5 on the back plate S2 and −12V is applied to unselected segments on the back plate S2.

In the first and second preferred embodiments of the present invention, V3 and V4 are set to be −25V and −12V, respectively. But, both V3 and V4 may be set to be −12V. In the preferred embodiments of the present invention, the following four cases (A) to (D) have been described:

(A) a first voltage V1 applied to unselected anode electrodes on the back plate S2 when the back anode electrodes on the back plate S2 are selected as light emitting electrodes;

(B) a first voltage V1 applied to selected anode electrodes on the front plate S1 when the back anode electrodes on the back plate S2 are selected as light emitting electrodes;

(C) a first voltage V1 applied to selected anode electrodes on the back plate S2 when the front anode electrodes on the front plate S1 are selected as light emitting electrodes;

(D) a first voltage V1 applied to unselected anode electrodes on the front plate S1 when the front anode electrodes on the front plate S1 are selected as light emitting electrodes. In this case all the V1's of the cases (A) to (D) have been set as equal to the filament voltage $V_f$. However, V1's of the cases (A) and (C) may be different from V1's of the cases (B) and (D). V1 of the case (A) may be different from V1 of the case (C); and V1 of the case (B) may be different from V1 of the case (D).

Figure 10:
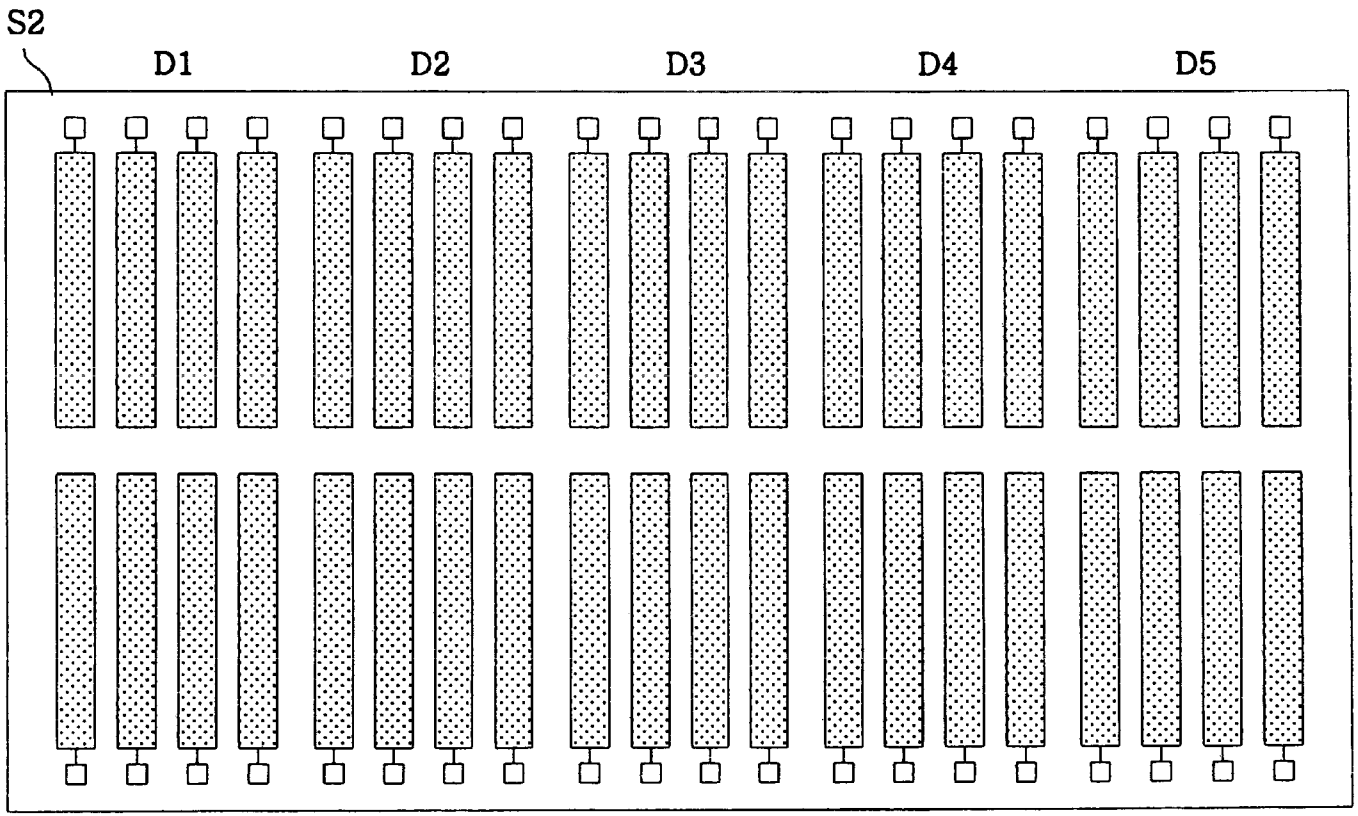
FIG. 10 represents segments of back anode electrode sets on the back plate in accordance with a third embodiment of the present invention.

FIG. 10 represents segments of back anode electrode sets D1 to D5 on the back plate S2 in accordance with a third embodiment of the present invention. Referring to FIG. 10, segments of back anode electrode sets D1 to D5 on the back plate S2 are divided into upper and lower segments, a terminal being connected to each of the upper and lower segments, wherein each of the upper and lower segments can be controlled independently. With this configuration, a duty ratio for a dynamic driving mode thereof becomes ⅛ to thereby increase the brightness in comparison with that, e.g., ⅙ of FIG. 5B and FIG. 6B.

Figure 11A:
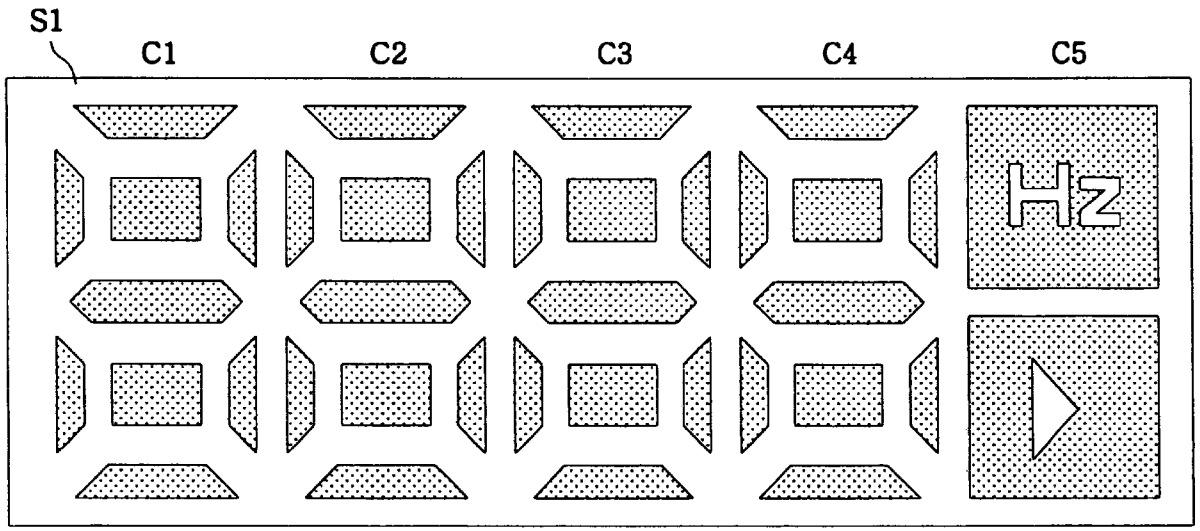
FIGS. 11A and 11B disclose arrangements of segments of anode electrode sets on the front plate S1 and the back plate S2, respectively in accordance with a fourth embodiment of the present invention.
Figure 11B:
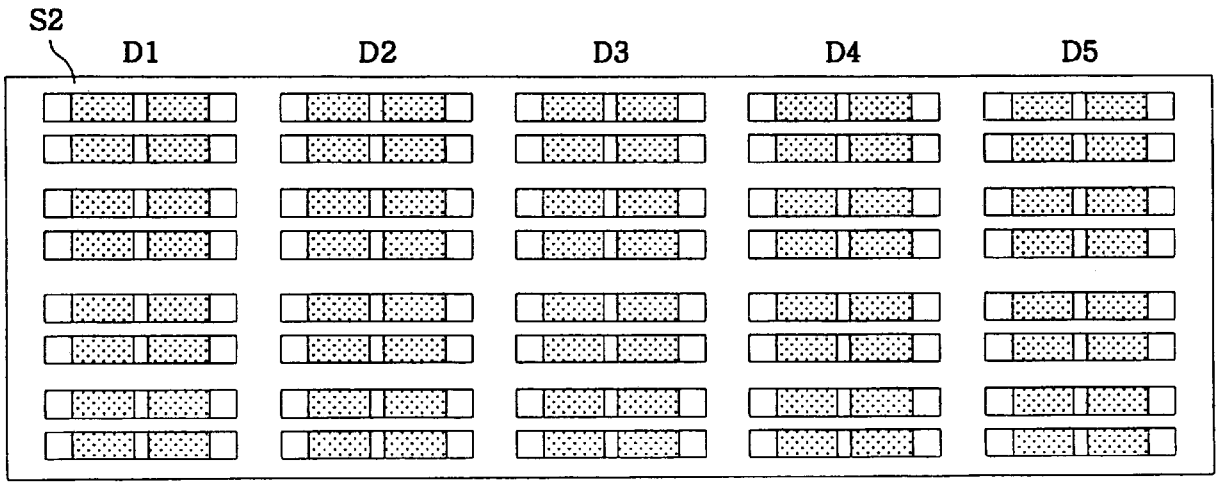

FIGS. 11A and 11B disclose arrangements of segments of back anode electrode sets D1 to D5 disposed in horizontal directions in bar shapes on the back plate S2 in accordance with a fourth preferred embodiment of the present invention, a terminal being connected to each segment. The displays of the back anode electrode sets D1 to D5 can be controlled on the basis of the intensity of a corresponding display signal, thereby enabling light emitting segments to be shifted in up or down.

In the above embodiments, the digital display has been illustrated by the display of the shape of "⊟" by using seven segments, but a digital display segment type is not limited to this. For an analog display, bar-shaped segments have been explained, but an analog display type segment is not limited to this. Further, the number of segments in the analog display bar-shaped segments may be varied.

Figure 12:
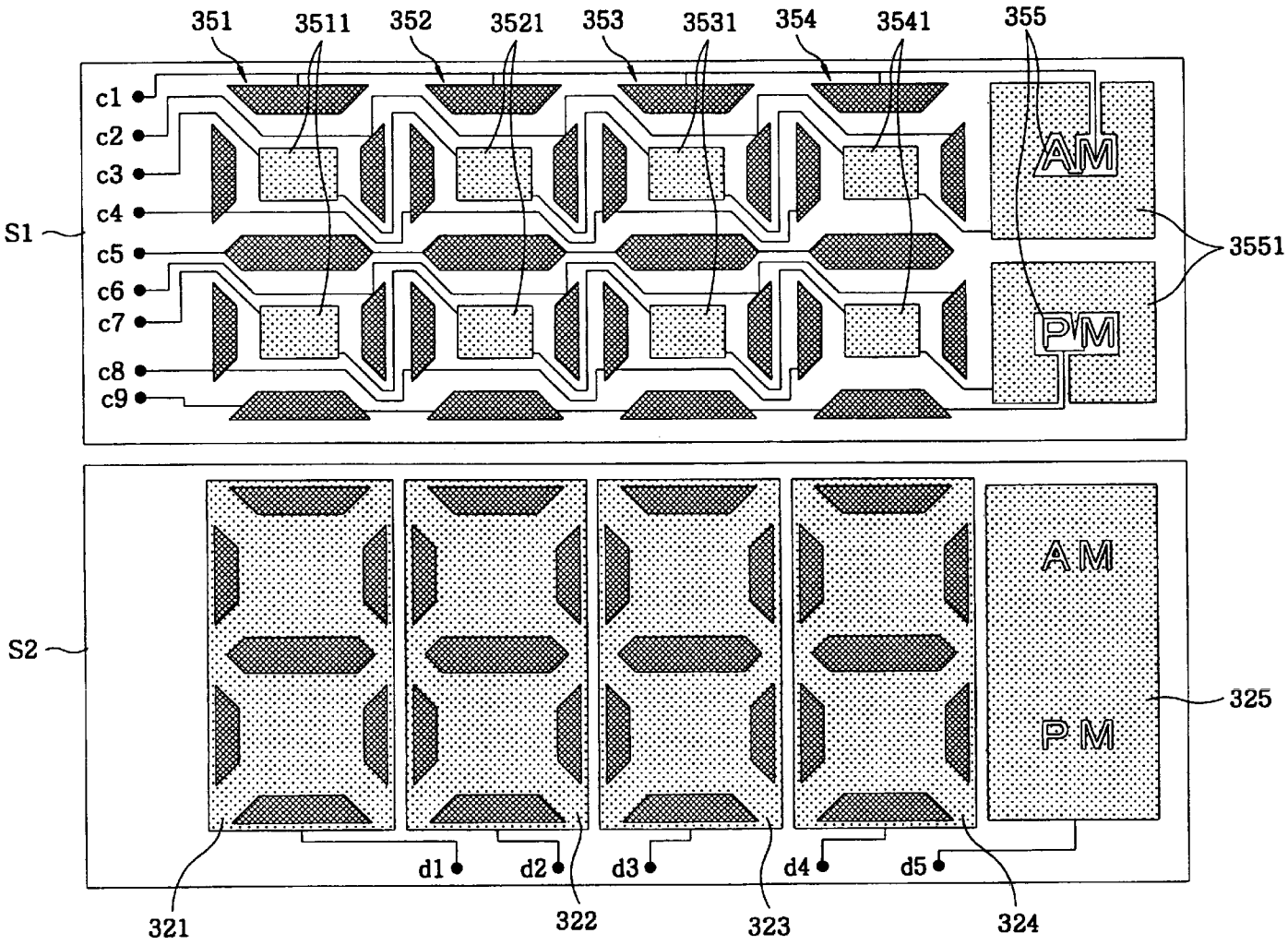
FIG. 12 pictorializes a wiring and a pattern of anode electrodes for the second preferred embodiment of the present invention.
Figure 13:
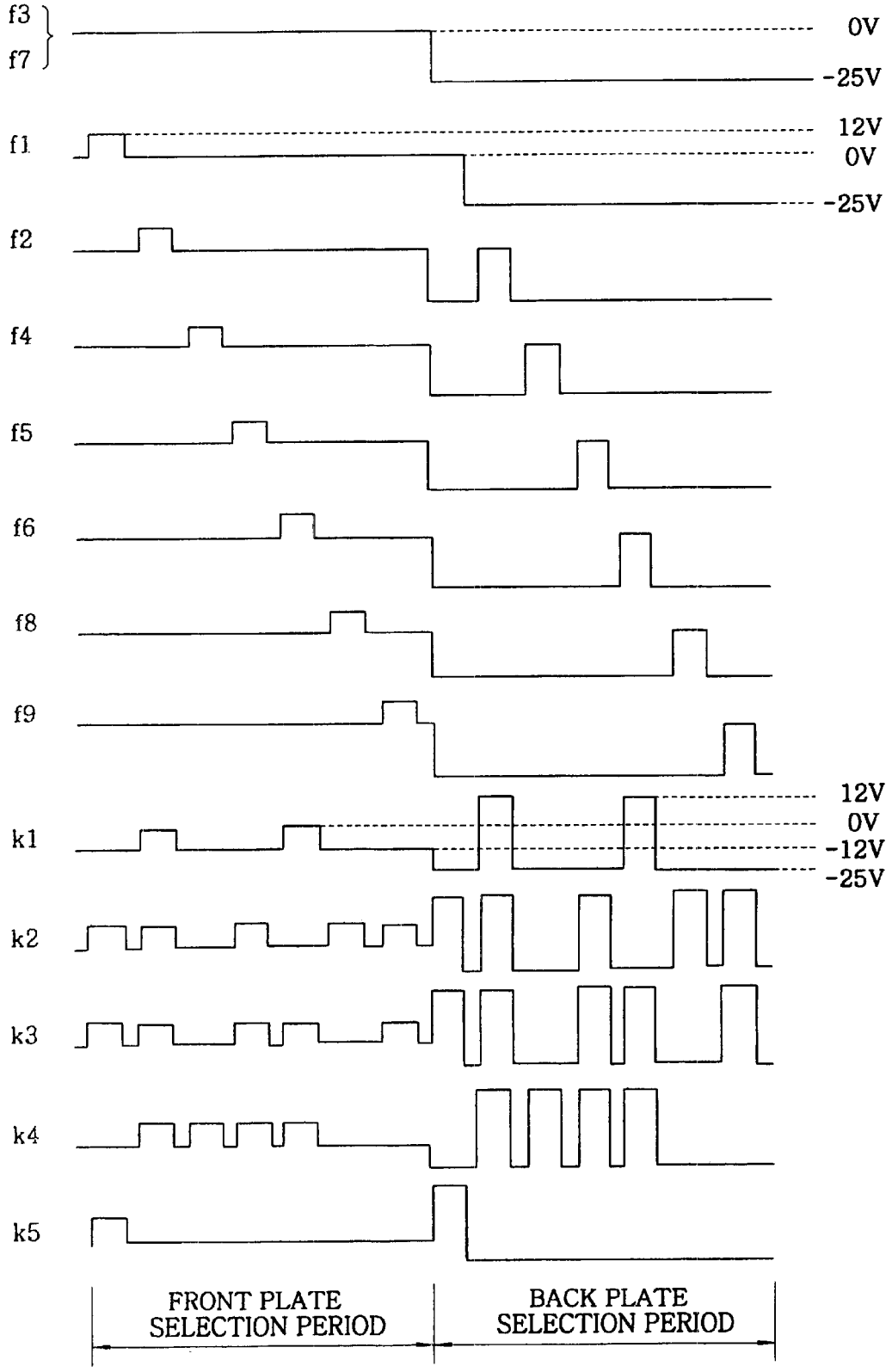
FIG. 13 exemplifies timing charts of signals applied to the front and back anode electrodes shown in FIG. 12.

FIG. 12 pictorializes a wiring and a pattern of anode electrodes for the second preferred embodiment of the present invention. FIG. 13 exemplifies timing charts of signals f1 to f9 applied to the terminals c1 to c9 of the front anode electrodes and those of signals k1 to k5 applied to the terminals d1 to d5 of the back anode electrode shown in FIG. 12. FIG. 13 exemplifies timing charts to display "1234AM" on the front plate S1 and the back plate S2. 0V is applied to a corresponding filament (not shown). A voltage applied to anode electrodes on the front plate S1 and the back plate S2 is 0V which is a first voltage (V1) equal to the filament voltage, i.e., the voltage applied to the filament; 12V is set as a second voltage (V2) higher than the filament voltage; −25V is set as a third voltage (V3) lower than the filament voltage; and −12V is set as a fourth voltage (V4), wherein V4 is lower than the filament voltage and higher than V3.

Filaments (not shown) common to the front and back anode electrodes are tightly hanged between the front plate S1 and the back plate S2 facing each other. It is preferable that five or more filaments are tightly hanged therebetween corresponding to segments connected to the terminals c1, c2 to c4, c5, c6 to c8 and c9 which will be described later.

There are formed five front anode electrode sets 351 to 355 on the front plate S1. Each of the front anode electrode sets 351 to 355 has seven segments constituting the shape "⊟", each segment containing a fluorescent layer coated thereon. The front anode electrode set 355 displays "AM" and "PM", each segment thereof containing a fluorescent layer coated thereon. The front anode electrodes 3511, 3521, 3531, 3541 and 3551 having no fluorescent layer thereon are used as control electrodes to control the electron emission from the filament toward the anode electrodes selected to emit light.

Each segment in one of the front anode electrode sets 351 to 355 is serially connected (so-called dynamically connected) to a corresponding segment in each of remaining front anode electrode sets, wherein the respective sets of corresponding segments are connected to terminals c1 to c9 as shown in FIG. 2. Signals f1 to f2, f4 to f6, f8 to f9 shown in FIG. 13 are applied to terminals c1 to c2, c4 to c6 and c8 to c9; and signals f3 and f7 shown in FIG. 13 are applied to terminals c3 and c7.

There are formed five back anode electrodes 321 to 325 on the back plate S2. Each of the back anode electrodes 321 to 325 is a common electrode for seven fluorescent segments constituting a shape "⊟". For example, the back anode electrode 325 is a common electrode for fluorescent segments "AM" and "PM". The anode electrodes 321 to 325 are connected to terminals d1 to d5, respectively. Signals k1 to k5 shown in FIG. 13 are applied to the terminals d1 to d5, respectively.

In order to display "1234AM" on the front plate S1 shown in FIG. 12, signals f1 to f9 during the front plate selection period depicted in FIG. 13 are applied to terminals c1 to c9 on the front plate S1, respectively and signals k1 to k5 are applied to terminals d1 to d5 on the back plate S2, respectively. In order to display "1234AM" on the back plate S2 shown in FIG. 12, signals f1 to f9 during the back plate selection period depicted in FIG. 13 are applied to terminals c1 to c9 on the front plate S1, respectively and signals k1 to k5 are applied to terminals d1 to d5 on the back plate S2, respectively.

In front plate selection period, from the terminals c1 to c2, c4 to c6 and c8 to c9 of the front plate S1, 12V is applied to selected segments of the front anode electrode sets 351 to 355; and 0V is applied to unselected segments. 0V is applied to the anode electrodes 3511, 3521, 3531, 3541 and 3551 from terminals c3 and c7 on the front plate S1. From the terminals d1 to c5 of the back plate S2, 0V is applied to selected segments of the back anode electrodes 321 to 325; and −12V is applied to unselected segments thereof.

In the back plate selection period as described above, from the terminals c1 to c2, c4 to c6 and c8 to c9 of the front plate S1, 0V is applied to selected segments of the front anode electrode sets 351 to 355; and −25V is applied to unselected segments thereof. From terminals c3 and c7 on the front plate S1, −25V is applied to the anode electrodes 3511, 3521, 3531, 3541 and 3551. From the terminals d1 to d5 of the back plate S2, 12V is applied to selected segments of the back anode electrodes 321 to 325; and −25V is applied to unselected segments thereof.

By repeating the front plate selection period and the back plate alternately, "1234AM" can be continuously displayed on both the front plate S1 and the back plate S2. Since the front anode electrodes 3511, 3521, 3531, 3541 and 3551 are supplementary electrodes, they may not be installed.

Figure 14:
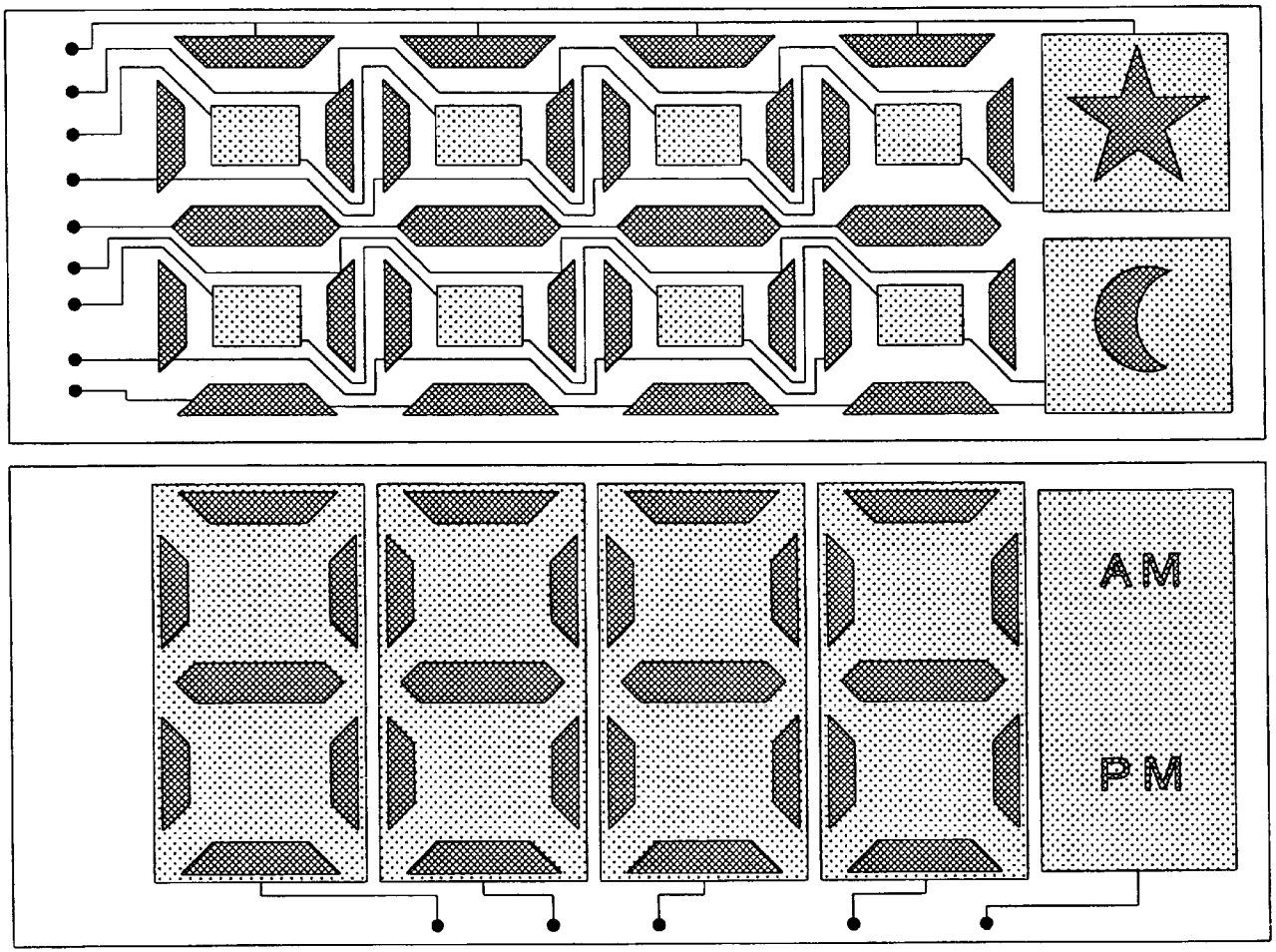
FIG. 14 yields exemplary anode patterns in accordance with a preferred embodiment of the present invention.
Figure 15A:
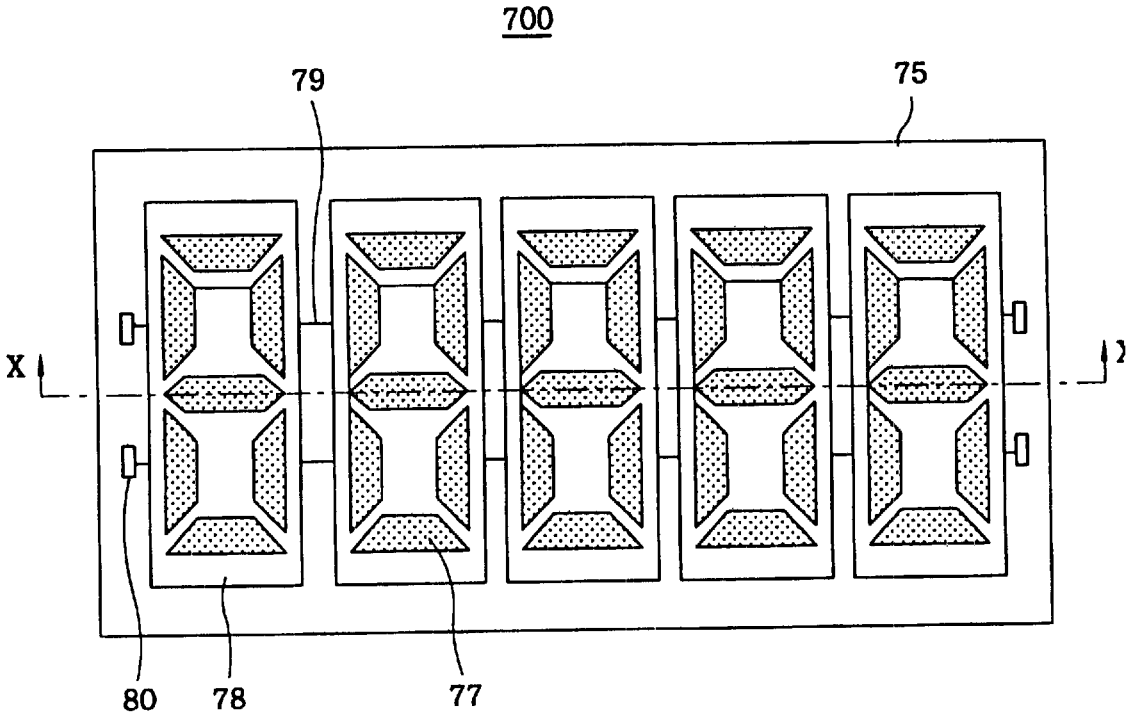
FIG. 15A PRIOR ART
FIGS. 15A and 15B exhibit cross sectional views of a conventional double-faced vacuum fluorescent display device.
Figure 15B:
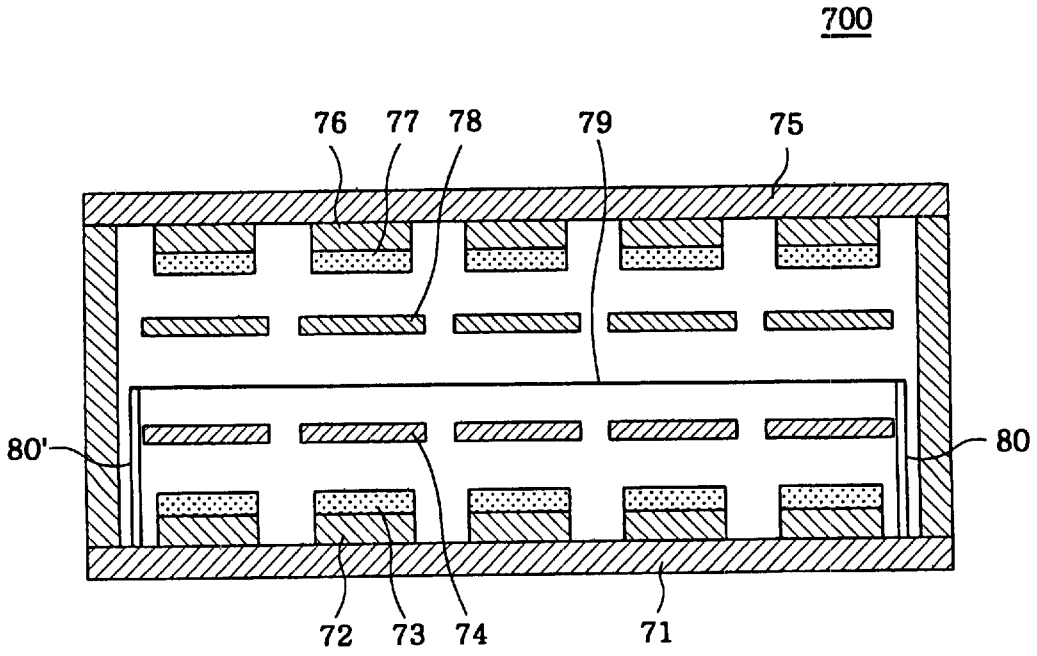
FIG. 15B PRIOR ART

FIG. 14 yields exemplary anode patterns in accordance with a fifth preferred embodiment of the present invention. A right most front anode electrode set in FIG. 14 is different from a corresponding electrode set of FIG. 12.

In the above first to fourth preferred embodiments of the present invention, the plates designated by S1 and S2 are the front plate and the back plate. In reverse, the plates designated by S1 and S2 may be the back plate and the front plate, respectively. The front plate and the back plate are usually made of glass, but not limited to this. The front plate and the back plate can be either transparent or opaque if they are made of insulating material, e.g., a layer containing a conductive layer coated thereon with insulation. However, at least the plate of the viewing side ought to be transparent.

The segments in the front anode electrode sets and the back anode electrode sets can be either transparent or opaque. If both the front plate and the back plate are used as viewing sides, anode electrodes on both the front plate and the back plate ought to be transparent. If one of the front plate and the back plate is used as a viewing side, at least anode electrodes on the plate used as the viewing side should be transparent. The transparent anode electrodes may be formed of a transparent conductive material or may be formed of an opaque conducting material in a through hole type such as aluminum which has through holes therein for letting light pass therethrough.

The filaments can be arranged parallel or non-parallel to the running direction of the anode electrodes. It is possible that atmospheric pressure sustaining poles can be used, if necessary, in the double-faced vacuum fluorescent display device of the present invention.

As described above, in the double-faced vacuum fluorescent display device of the present invention, the front anode electrodes function as control electrodes to control the electron emission from the filament toward the back anode electrodes; and the back anode electrodes function as control electrodes to control the electron emission from the filament toward the front anode electrodes.

Accordingly, there is provided a simple and slim double-faced vacuum fluorescent display device with low fabrication cost, e.g., due to simplicity in the arrangement process thereof, in accordance with the present invention. The double-faced vacuum fluorescent display device of the present invention has no grid, thereby lowering the power consumption. Further, in the double-faced vacuum fluorescent display device of the present invention, the light emitted from the anode electrodes is neither cut nor degraded by grids, thereby enhancing light emitting efficiency thereof.

Since, in accordance with the present invention, in digital and/or analog display, the display range can be enlarged and the contents of the display can be rich.

While the present invention has been described with respect to certain preferred embodiments only, other modifications and variations may be made without departing from the scope of the present invention as set forth in the following claims.

What is claimed is:

1. A double-faced vacuum fluorescent display device including a front plate, a back plate and a filament installed between the front plate and the back plate facing each other, characterized in that the front plate has one or more front anode electrodes and the back plate has one or more back anode electrodes, each anode electrode containing a fluorescent layer coated thereon; the front anode electrodes function as control electrodes to control an electron emission from the filament toward the back anode electrodes; and the back anode electrodes function as control electrodes to control the electron emission from the filament toward the front anode electrodes.

2. The device of claim 1, wherein the front anode electrodes and the back anode electrodes exist as anode electrode sets, respectively, each anode electrode set having a plurality of anode electrodes; and each anode electrode in an anode electrode set on one of the front plate and the back plate is connected to a corresponding anode electrode in each of the remaining anode electrode sets on said one of the front plate and the back plate.

3. The device of claim 1, wherein the front anode electrodes and the back anode electrodes exist as anode electrode sets, respectively, each anode electrode set having a plurality of anode electrodes; and the anode electrodes on one of the front plate and the back plate are arranged in the shapes of parallel bars in a crossing direction to the anode electrodes on the other plate.

4. The device of claim 1, wherein the front anode electrodes and the back anode electrodes exist as anode electrode sets, respectively, each anode electrode set having a plurality of anode electrodes; and the anode electrode sets on one of the front plate and the back plate represent a digital display image and the other anode electrode sets represent an analog display image.

5. The device of claim 1, wherein the front anode electrodes and the back anode electrodes exist as anode electrode sets, respectively, each anode electrode set having a plurality of anode electrodes; and each of the plurality of anode electrodes contains a multiplicity of electrode segments.

6. The device of claim 1, wherein the front anode electrodes are installed within a range to allow control of the electron emission from the filament toward the back anode electrodes to be performed; and the back anode electrodes are installed within a range to allow control of the electron emission from the filament toward the front anode electrodes to be performed.

7. The device of claim 1, wherein the front anode electrodes are grouped into plural sets of front electrodes and an electrode of each of the plural sets is connected to a corresponding electrode of each of the remaining sets; the back plate is divided into a number of regions, each region having a plurality of fluorescent segments; and the fluorescent segments of each region are commonly connected to one of the back anode electrodes.

8. The device of claim 1, wherein a filament voltage is represented as $V_f$ and there are defined a set of first voltages V1i (i=1,2,3,4), a second voltage V2 and a third voltage V3, wherein $V2>V_f$, $V3<V_f$, $V2>V1i$ if $V1i>V_f$, $V3<V1i$ if $V1i<V_f$; when the back anode electrodes are selected as light emitting electrodes, a V2, a V11, a V12 and a V3 are applied to selected anode electrodes on the back plate, unselected anode electrodes on the back plate, selected anode electrodes on the front plate and unselected anode electrodes on the front plate, respectively; and when the front anode electrodes are selected as light emitting electrodes, a V13, a V3, a V2 and a V14 are applied to selected anode electrodes on the back plate, unselected anode electrodes on the back plate, selected anode electrodes on the front plate and unselected anode electrodes on the front plate, respectively.

9. The device of claim 1, wherein a filament voltage is represented as $V_f$ and there are defined a set of first voltages V1i (i=1,2,3,4), and second to fourth voltages V2 to V4, wherein $V2>V_f$, $V3<V_f$, $V3<V4<V_f$, $V2>V1i$ if $V1i>V_f$, $V4<V1i$ if $V1i<V_f$; when the back anode electrodes are selected as light emitting electrodes, a V2, a V11, a V12 and a V3 are applied to selected anode electrodes on the back plate, unselected anode electrodes on the back plate, selected anode electrodes on the front plate and unselected anode electrodes on the front plate, respectively; and when the front anode electrodes are selected as light emitting electrodes, a V13, a V4, a V2 and a V14 are applied to selected anode electrodes on the back plate, unselected anode electrodes on the back plate, selected anode electrodes on the front plate and unselected anode electrodes on the front plate, respectively.

10. A method for driving a double-faced vacuum fluorescent display device in claim 1, wherein the front anode electrodes control the electron emission from the filament toward the back anode electrodes; and the back anode electrodes control the electron emission from the filament toward the front anode electrodes.

11. A method for driving a double-faced vacuum fluorescent display device in claim 1, wherein a filament voltage is represented as $V_f$ and there are defined a set of first voltages V1i (i=1,2,3,4), a second voltage V2 and a third voltage V3, wherein $V2>V_f$, $V3<V_f$, $V2>V1i$ if $V1i>V_f$, $V3<V1i$ if $V1i<V_f$; when the back anode electrodes are selected as light emitting electrodes, a V2, a V11, a V12 and a V3 are applied to selected anode electrodes on the back plate, unselected anode electrodes on the back plate, selected anode electrodes on the front plate and unselected anode electrodes on the front plate, respectively; and when the front anode electrodes are selected as light emitting electrodes, a V13, a V3, a V2 and a V14 are applied to selected anode electrodes on the back plate, unselected anode electrodes on the back plate, selected anode electrodes on the front plate and unselected anode electrodes on the front plate, respectively.

12. A method for driving a double-faced vacuum fluorescent display device in claim 1, wherein a filament voltage is represented as $V_f$ and there are defined a set of first voltages V1i (i=1,2,3,4), and second to fourth voltages V2 to V4, wherein $V2>V_f$, $V3<V_f$, $V3<V4<V_f$, $V2>V1i$ if $V1i>V_f$, $V4<V1i$ if $V1i<V_f$; when the back anode electrodes are selected as light emitting electrodes, a V2, a V11, a Vl2 and a V3 are applied to selected anode electrodes on the back plate, unselected anode electrodes on the back plate, selected anode electrodes on the front plate and unselected anode electrodes on the front plate, respectively; and when the front anode electrodes are selected as light emitting electrodes, a V13, a V4, a V2 and a V14 are applied to selected anode electrodes on the back plate, unselected anode electrodes on the back plate, selected anode electrodes on the front plate and unselected anode electrodes on the front plate, respectively.

13. The device of claim 8, wherein the V11 and the V13 are different from the V12 and the V14.

14. The device of claim 8, wherein the V11 is different from the V13.

15. The device of claim 8, wherein the V12 is different from the V14.

16. The method of claim 11, wherein the V11 and the V13 are different from the V12 and the V14.

17. The method of claim 11, wherein the V11 is different from the V13.

18. The method of claim 11, wherein the V12 is different from the V14.

19. A double-faced vacuum fluorescent display device including a front plate, a back plate and a filament installed between the front plate and the back plate facing each other, characterized in that the front plate has one or more front anode electrodes and the back plate has one or more back anode electrodes, each anode electrode containing a fluorescent layer coated thereon; when the front anode electrodes are selected to be turned on to emit light, the back anode electrodes function as control electrodes to control an electron emission from the filament toward the front anode electrodes; and when the back anode electrodes are selected to be turned on to emit light, the front anode electrodes function as control electrodes to control the electron emission from the filament toward the back anode electrodes.

* * * * *